US007778430B2

(12) United States Patent
Nakajima et al.

(10) Patent No.: US 7,778,430 B2
(45) Date of Patent: Aug. 17, 2010

(54) FLESH CONDUCTED SOUND MICROPHONE, SIGNAL PROCESSING DEVICE, COMMUNICATION INTERFACE SYSTEM AND SOUND SAMPLING METHOD

(75) Inventors: Yoshitaka Nakajima, Nara (JP); Makoto Shozakai, Atsugi (JP); Sakae Fujimaki, Fuji (JP)

(73) Assignee: National University Corporation Nara Institute of Science and Technology, Nara (JP)

( * ) Notice: Subject to any disclaimer, the term of this patent is extended or adjusted under 35 U.S.C. 154(b) by 994 days.

(21) Appl. No.: 10/585,135

(22) PCT Filed: Jan. 11, 2005

(86) PCT No.: PCT/JP2005/000444

§ 371 (c)(1),
(2), (4) Date: Jun. 30, 2006

(87) PCT Pub. No.: WO2005/067340

PCT Pub. Date: Jul. 21, 2005

(65) Prior Publication Data

US 2009/0175478 A1 Jul. 9, 2009

(30) Foreign Application Priority Data

Jan. 9, 2004 (JP) ..... 2004-004163

(51) Int. Cl.
*H04R 25/00* (2006.01)

(52) U.S. Cl. ..... 381/151; 381/326; 381/380

(58) Field of Classification Search ..... 381/151, 381/326, 380, 23.1, 312, 315
See application file for complete search history.

(56) References Cited

U.S. PATENT DOCUMENTS 4,052,572 A * 10/1977 Schafer ..... 381/326
6,879,693 B2 * 4/2005 Miller et al. ..... 381/326
6,952,483 B2 * 10/2005 Boesen et al. ..... 381/326

FOREIGN PATENT DOCUMENTS

DE 2451977 5/1975
JP 50-113217 9/1975

(Continued)

OTHER PUBLICATIONS

International Preliminary Report on Patentability dated Oct. 26, 2006 issued in corresponding International Application.

(Continued)

*Primary Examiner*—Suhan Ni
(74) *Attorney, Agent, or Firm*—Finnegan, Henderson, Farabow, Garrett & Dunner, L.L.P.

(57) ABSTRACT

A microphone is installed on a surface of the skin immediately below the mastoid of a human to implement a sound sampling method including sampling at least one of a non-audible murmur, a whisper, or an audible sound. The microphone includes a condenser microphone portion having a pair of diaphragm electrodes and a contact portion which has an acoustic impedance close to the acoustic impedance of soft tissues in a body of a speaker, which is stuck tightly to the condenser microphone portion with no intervening air space, and which conducts an input speech from a skin surface of the speaker to the condenser microphone.

15 Claims, 18 Drawing Sheets

FOREIGN PATENT DOCUMENTS

| | | |
|---|---|---|
| JP | 59-191996 | 10/1984 |
| JP | 60-22193 | 2/1985 |
| JP | 60-22913 | 2/1985 |
| JP | 2-5099 | 1/1990 |
| JP | 4-316300 | 11/1992 |
| JP | 5-333894 | 12/1993 |
| JP | 8-275279 | 10/1996 |
| JP | 8-305375 | 11/1996 |
| JP | 3038167 | 3/1997 |
| JP | 2000-60844 | 2/2000 |

OTHER PUBLICATIONS

Nakajima, et al., "Non-Audible Murmur Recognition Input Interface Using Stethoscopic Microphone Attached to the Skin", In: Proc. ICASSP, Singapore, vol. V, pp. 708-711, (2003).

* cited by examiner

SOFT SILICONE

ELASTIC SILICONE

HARD SILICONE

4

15

FLESH CONDUCTED SOUND MICROPHONE, SIGNAL PROCESSING DEVICE, COMMUNICATION INTERFACE SYSTEM AND SOUND SAMPLING METHOD

TECHNICAL FIELD

The present invention relates to a microphone, a signal processing device, a communication interface system and a sound sampling method, and more particularly to a microphone for sampling vibratory sounds which result from the conduction of non-audible respiratory sounds of infinitesimal quantities (the quantity of expiration and that of inspiration) by soft tissues in the body (such as flesh) (hereinafter referred to as "flesh-conduction") not involving regular vibrations of the vocal cords articulated by variations in resonance filter characteristics accompanying the motions of phonatory organs and not intended to be heard by persons around (hereinafter referred to as "non-audible murmur" (NAM)) and a signal processing device, a communication interface systemand a sound sampling method using it.

BACKGROUND ART

The rapidly spreading use of mobile telephones has given rise to problems of call manner in the means of public transport, such as trains and buses . Mobile telephones are the same in basic structure of interface as analog telephones of the past; since they sample air-conducted voices, speaking over a mobile telephone in an environment where other persons are present, there arises the problem of annoying them. Everybody must have experienced displeasure of being forced to hear another person's conversation by mobile telephone in train.

Along with that, there is another intrinsic shortcoming of conduction by air that the contents of conversation are heard by persons around, resulting in a risk of information leak and inevitable difficulty of publicity control.

At the same time, when the other party is speaking in a place where background noise is high, air conduction entails another problem that the other party's voice mixed with the background noise cannot be heard clearly.

On the other hand, speech recognition is a technology built up having a history of some 30 years behind it and, in terms of its recognition rate, large-vocabulary consecutive speech recognition and other techniques have raised the word recognition to or beyond 90% in dictation. Speech recognition is an input method usable by anybody for a personal digital assistant terminal, such as a wearable computer, or a robot without requiring any particular skill to be learned, and has been considered promising as method of utilizing spoken language culture, familiar over a long time as an aspect of human culture, directly to the transmission of information.

However, all the time since the days of analog telephone or since the beginning of development of speech recognition techniques, what are addressed by speech input techniques have been sounds sampled by an external microphone always positioned away from the speaker's mouth. Even though a highly directional microphone is used or contrivances in both hardware and software aspects have been built up to reduce noise, there has been no change to date in the circumstance that speech radiated from the mouth, conducted by air and reaching an external microphone is the object of analysis.

One seldom encounters a real situation in which speech recognition addressing this air-conducted normal speech as its object of analysis is used for inputting to a computer or a robot except in some use for car navigation, even though it has a long history of development, easy-to-handle products have been developed and has fully sufficient accuracy for practical use in a quiet environment not only in command recognition but also in dictation.

Conceivable reasons for this include, first, the mixing of external background noise is inevitable as a fundamental disadvantage of air conduction. Even in an office, which is a quiet environment, various kinds of noise may occur in unexpected situations and induce recognition errors. Where a sound collecting device is disposed on the body surface or the like of a robot, information once pronounced as speech may be erroneously recognized under the influence of background noise and conceivably converted into a dangerous instruction.

Conversely, what poses a problem in use in a quiet environment is that utterance of speech constitutes noise to the surroundings. If each individual in an office is to use speech recognition, it will be difficult unless the room is partitioned, and such use is difficult as a matter of reality.

Further, related to this, the tendency of people "to refrain from express in words freely" or "to feel bashful to say it in words", which is a feature of Japanese culture, may conceivably constitute an obstacle to more extensive use of speech recognition.

Looking ahead to the future when opportunities to use personal digital assistant terminals outdoors or on vehicles will dramatically increase, this disadvantage poses an essentially grave problem.

When research and development of speech recognition technology was begun, the global network environment and the personal mobile terminals which we have today were not anticipated. Considering that the use of wireless communication and wearable devices will become even more common in the future, it would be far safer to send information, whether in a wireless or wired manner, after the result of speech recognition is visually checked and corrected on a personal digital assistant terminal.

In mobile telephones or speech recognition in which air-conducted ordinary speech signals sampled by an external microphone as described above are parameterized and made the object of analysis, the object of analysis in itself has such shortcomings as susceptibility to mixing of noise, generation of noise and leaking of information and the difficulty of correction.

It is desired to fundamentally improve these shortcomings and to provide a new input method for personal digital assistant terminals to be used today and in the near future which is simple, requires no training and conforms to the long-established human cultural customs and a device its realization.

Incidentally, a method using bone conduction is known as a method of sampling ordinary speech signals by another means than air conduction. The principle of bone conduction is that, when the vocal cords are vibrated to emit voices, the vibration of the vocal cords is conducted to the skull and further conducted to the spirally shaped cochleas (in internal ears), and electric signals generated by the vibration of the lymph within the cochleas are sent to the auditory nerve to make the brain recognize the sounds.

A bone-conduction loudspeaker utilizing the principle of bone conduction according to which sounds are conducted to the skull is used for the purpose of making sounds better audible in an environment of high background noise or to hearing-impaired persons or aged persons who have trouble in eardrum or auditory ossicle by converting the sounds into vibration by a vibrator and bringing the vibrator into contact with the ear, a bone around the ear, the temple, the mastoid or the like to have the sounds conveyed to the skull.

For instance, JP59-191996A (hereinafter referred to as Patent Document 1) discloses a technique regarding auditory organs by which a vibrator is brought into contact with a mastoid above the skull using both bone conduction and air conduction. However, the technique disclosed in Patent Document 1 does not disclose any method of sampling sounds pronounced by a human.

In JP50-113217A (hereinafter referred to as Patent Document 2), there is disclosed a technique regarding a sound reproducing device by which sounds radiated from the mouth, conducted by air and sampled by a microphone and sounds sampled by another microphone fitted over Adam's apple are heard from an earphone and a vibrator fitted over the mastoid of the skull. However, the technique disclosed in Patent Document 2 does not disclose any method of sampling sounds pronounced by a human by fitting a microphone immediately underneath the mastoid.

In JP4-316300A (hereinafter referred to as Patent Document 3), there is disclosed a technique regarding an earphone type microphone and speech recognition using it. By the technique disclosed in Patent Document 3, voices pronounced by regularly vibrating the vocal cords and vibrations of intra-body sounds, such as the chewing sound, transmitted from the oral cavity via the nasal cavity and further via the Eustachian tube and the eardrum to the external ear consisting of the external auditory canal and the cavity of concha. It is claimed that mixing of noise, generation of noise and leaking of information and the difficulty of correction can be thereby averted, and so faint voices as murmurs can be clearly sampled. However, it is not expressly stated that non-audible murmurs not involving regular vibration of the vocal cords can be sampled by the technique disclosed in Patent Document 3.

In JP5-333894A (hereinafter referred to as Patent Document 4), there is disclosed a technique regarding an earphone type microphone provided with vibration sensors for detecting voices pronounced by regularly vibrating the vocal cords and human body signals, such as the chewing sound, and speech recognition using it. By the technique disclosed in Patent Document 4, the ear hole, surroundings of the ear, the surface of the head and the surface of the face are expressly stated as regions in which the vibration sensors are to be fixed. The human body vibrations sampled by vibration sensors are used for the sole purpose of extracting and classifying, out of the signals sampled by the microphone, only the signals during the time segments in which the speaker himself or herself pronounced voices and inputting the extracted and classified signals to the speech recognition device. However, it is not expressly stated that the human body vibrations themselves can be used as input to the speech recognition device or for communication by mobile telephone by the technique disclosed in Patent Document 4. Much less is expressly stated that non-audible murmurs not involving regular vibration of the vocal cords can be used as input to the speech recognition device or for communication by mobile telephone.

In JP60-22193A (hereinafter referred to as Patent Document 5), there is disclosed a technique by which, out of microphone signals sampling normal air conduction, only the signals during the time segments in which a throat microphone to be fitted to Adam's apple or an earphone type bone conduction microphone detects human body vibrations, and the extracted and classified signals are inputted to the speech recognition device. However, it is not expressly stated that the human body vibrations themselves can be used as input to the speech recognition device or for communication by mobile telephone by the technique disclosed in Patent Document 5. Much less is expressly stated that non-audible murmurs not involving regular vibration of the vocal cords can be used as input to the speech recognition device or for communication by mobile telephone.

In JP2-5099A (hereinafter referred to as Patent Document 6) there is disclosed a technique by which, out of microphone signals sampling normal air conduction, the time segments in which a throat microphone to be fitted to Adam's apple or vibration sensors have detected regular vibrations of the vocal cords are determined to be voiced, the time segments in which no regular vibrations of the vocal cords are detected but energy of or above a certain level is present are determined to be unvoiced, and the time segments in which energy is below a certain level are determined to be silent. However, it is not expressly stated that the human body vibrations themselves can be used as input to the speech recognition device or for communication by mobile telephone by the technique disclosed in Patent Document 6. Much less is expressly stated that non-audible murmurs not involving regular vibration of the vocal cords can be used as input to the speech recognition device or for communication by mobile telephone.

Incidentally, literature by Y. Nakajima et al. entitled "Non-audible Murmur Recognition input Interface Using Stethoscopic Microphone Attached to the Skin," Proc. ICASSP, Singapore, Singapore, vol. V, pp. 708-711, 2003 (hereinafter referred to as Non-Patent Document 1) discloses a method by which non-audible murmurs are detected by a stethoscope type condenser microphone. By this method, in the field of communication by remote conversation media such as mobile telephones, command control by speech recognition and inputting of information such as characters and data, instead of sampling with a microphone positioned away from the mouth air-conducted voices audible to persons around (including ordinary speeches involving regular vibrations of the vocal cords and a large volume of respiration intended to be heard by persons around, murmurs involving regular vibrations of the vocal cords and a relatively small volume of respiration not intended to be heard by persons around, low voices involving regular vibrations of the vocal cords and a relatively small volume of respiration intended to be heard by persons around, and whispers involving no regular vibrations of the vocal cords but a relatively small volume of respiration intended to be heard by persons around), the microphone is installed on the skin on the sternocleidomastoid muscle immediately below the mastoid (the part where a bone slightly protrudes behind the ear) of the skull downward behind the auricle (hereinafter abbreviated to "sub-mastoid part"), and vibratory sounds which result from the conduction of non-audible respiratory sounds of infinitesimal quantities (the quantity of expiration and that of inspiration) by soft tissues in the body (such as flesh) (hereinafter referred to as "flesh-conduction") not involving regular vibrations of the vocal cords by variations in resonance filter characteristics accompanying the motions of phonatory organs and not intended to be heard by persons around (hereinafter referred to as "non-audible murmurs") are sampled.

In this way, it is made possible for speech information to be communicated or inputted not letting acoustic background noise come in and persons around hear the speech contents because of their non-audibility, allowing the control of information leaks, and not disturbing the quiet environment of an office or the like, and for a new input interface for computers, mobile telephones and eventually personal digital assistant terminals such as wearable computers.

However, according to Non-Patent Document 1, since an air space intervenes between the skin surface over soft tissues in the body and the condenser microphone and mismatching in acoustic impedance is present on the interface between the skin surface over soft tissues in the body, which are mainly liquid, and the air space, which is gaseous, the high frequency region attenuates, making it impossible to obtain the spectrum of bands at or above 2 kHz.

An object of the present invention, attempted to solve the problems of the background art described above, is to provide a flesh conducted sound microphone, a signal processing device, a communication interface system and a sound sampling method which, when non-audible murmurs are to be obtained with maximum possible fidelity from the skin surface over the sternocleidomastoid muscle immediately below the mastoid of the skull, that is, in the lower part of the skin behind the auricle, can restrain the attenuation of the high frequency region attributable to mismatching of acoustic impedance on the interface between the skin surface over soft tissues in the body, which are mainly liquid, and the air space, which is gaseous, and obtain the spectrum of bands at or above 2kHz.

DISCLOSURE OF THE INVENTION

A microphone according to the present invention is installed on a surface of the skin on the sternocleidomastoid muscle immediately below the mastoid of the skull, that is, in the lower part of the skin behind the auricle, intended to sample at least one of a non-audible murmur articulated by a variation resonance filter characteristics associated with motion of the phonatoroy organ, the non-audible murmur not involving regular vibration of the vocal cords, the non-audible murmur being a vibration sound generated when an externally non-audible respiratory sound is transmitted through internal soft tissues, a whisper which is audible but is uttered without regularly vibrating the vocal cords, a sound uttered by regularly vibrating the vocal cords and including a low voice and a murmur, and inputting speech such as a teeth gnashing sound and a tongue clucking sound. The microphone comprises a condenser microphone portion having a pair of diaphragm electrodes and a contact portion which has an acoustic impedance close to the acoustic impedance of soft tissues in the body, is stuck tightly to thecondenser microphone portion with no intervening air space and conducts the input speech from the skin surface to the condenser microphone. Such a configuration makes it possible to restrain attenuation of the high frequency region attributable to mismatching of acoustic impedance.

Further, it is desirable for the contact portion to be formed of hardened silicone rubber. By using hardened silicone rubber having an acoustic impedance close to the acoustic impedance of soft tissues in the body, it is made possible to restrain the attenuation of the high frequency region attributable to mismatching of acoustic impedance and obtain the spectrum of bands at or above 2 kHz.

And it is desirable for the hardened silicone rubber not only to cover the condenser microphone portion but also to fill the whole inside of the microphone. Such a configuration would facilitate molding and enable the microphone to be realized less expensively.

It is desirable for the hardness of the hardened silicone rubber to be not higher than 30 (Shore A). The use of silicone rubber of such a hardness would enable satisfactory characteristics to be obtained.

It is desirable for the hardened silicone rubber to be addition reaction-setting organo-polysiloxane, silica fine powder to be 10 to 60 weight parts, and organo-hydrogen polysiloxane to be 1 to 60 weight parts. The use of silicon rubber of such a composition would enable satisfactory characteristics to be obtained.

Incidentally, the shape of the contact portion may be such that the sectional area thereof becomes gradually smaller from the condenser microphone portion toward the skin surface. By using a contact portion of such a shape, secure contact with an appropriate region of the skin surface of a sub-mastoid part is made possible, enabling non-audible murmurs to be securely conducted.

Also, the shape of the contact portion may be such that the sectional area thereof becomes gradually larger from the condenser microphone portion toward the skin surface. As the use of a contact portion of such a shape results in a large area of contact with the skin surface, non-audible murmurs conducted by soft tissues in the body can be obtained in a greater amplitude even if a condenser microphone of the same size is used.

The condenser microphone portion may as well be disposed submerged in the contact portion. By submerging the whole condenser microphone completely in the contact portion, external noise can be more securely prevented from coming in.

A reinforcing portion which is harder than the contact portion and covers other parts than the face of the contact portion coming into contact with the skin surface, and a reflector which is disposed on the interface between the contact portion and the reinforcing portion and reflects the non-audible murmurs may be further included. Such a configuration, as it causes non-audible murmurs conducted by soft tissues in the body to be reflected inward on the internal face of the reflector and to concentrate on the diaphragm electrodes of the condenser microphone, enables the non-audible murmurs to be obtained in a greater amplitude.

The condenser microphone portion may be turned upside down. Such a configuration, as it causes non-audible murmurs conducted by soft tissues in the body to be reflected inward on the internal face of the reflector and to concentrate on the diaphragm electrodes of the condenser microphone, enables the non-audible murmurs to be obtained in a greater amplitude.

The reflector may have a parabolic shape, namely a shape following a parabola. Such a configuration, as it causes non-audible murmurs to be reflected inward on the internal face of the reflector and to concentrate on the diaphragm electrodes of the condenser microphone, enables them to be obtained in a greater amplitude.

Incidentally, integral configuration with a head wearing object to be fitted to the head of a human, such as spectacles, headphones, an earphone, a cap or a helmet is also conceivable. Integration of the microphone with a head wearing object would enable the microphone to be fitted without giving an awkward feeling.

A signal processing device according to the present invention which subjects to signal processing input signals from a microphone to be installed on a surface of the skin on the sternocleidomastoid muscle immediately below the mastoid of the skull, that is, in the lower part of the skin behind the auricle, intended to sample at least one of a non-audible murmur articulated by a variation in resonance filter characteristics associated with motion of the phonatory organ, the non-audible murmur not involving regular vibration of the vocal cords, the non-audible murmur being a vibration sound generated when an externally non-audible respiratory sound is transmitted through internal soft tissues, a whisper which is audible but is uttered without regularly vibrating the vocal cords, a sound uttered by regularly vibrating the vocal cords and including a low voice and a murmur, and input speech such as a teeth gnashing sound and a tongue clucking sounds, the microphone comprising a condenser microphone portion having a pair of diaphragm electrodes and a contact portion which has an acoustic impedance close to the acoustic impedance of soft tissues in the body, is stuck tightly to the condenser microphone portion with no intervening air space and conducts the input speech from the skin surface to the condenser microphone. The use of such a signal processing device makes it possible to restrain attenuation of the high frequency region attributable to mismatching of acoustic impedance.

A communication interface system according to the present invention is characterized in that it uses for communication the result of signal processing by the signal processing device described above. The use of such a communication interface system enables communication to be performed while restraining attenuation of the high frequency region attributable to mismatching of acoustic impedance.

A sound sampling method according to the present invention by which a microphone samples at least one of a non-audible murmur articulated by a variation in resonance filter characteristics associated withmotion of the phonatoryorgan, the non-audible murmur not involving regular vibration of the vocal cord, the non-audible murmur being a vibration sound generated when an externally non-audible respiratory sound is transmitted through internal soft tissues, a whisper which is audible but is uttered without regularly vibrating the vocal cords, a sound uttered by regularly vibrating the vocal cords and including a low voice and a murmur, and input speech such as a teeth gnashing sound and a tongue clucking sound, comprising:

the microphone causes the input speech to be conducted from the skin surface to a condenser microphone having a pair of diaphragm electrodes and stuck tightly to the condenser microphone portion with no intervening air space via a contact portion whose acoustic impedance is matched to an acoustic impedance close to the acoustic impedance of soft tissues in the body, and is installed on a surface of the skin on the sternocleidomastoid muscle immediately below the mastoid of the skull, that is, in the lower part of the skin behind the auricle. The use of such a sound sampling method makes it possible to restrain attenuation of the high frequency region attributable to mismatching of acoustic impedance.

In short, the present invention concerns use of non-audible murmurs for communication. Non-audible murmurs uttered without regular vibrations of the vocal cords are articulated by a variation in resonance filtercharacteristics associated with motions of articulatory organs including the tongue, lips, jaw and soft palate substantially similarly to normal speech uttered by regularly vibrating the vocal cords, and undergo flesh-conduction.

According to the present invention, the microphone is fitted in tight adherence immediately below the sternocleidomastoid muscle. When amplifying the muscle-conducted vibratory sounds of non-audible murmurs are amplified and listened to, they can be distinguished and understood as human speech resembling whispers. Moreover in a normal environment, it is not heard by any other person even within a radius of 1 m. These muscle-conducted vibratory sounds of non-audible murmurs not air-conducted are made the object of analysis and parameterization.

These amplified muscle-conducted vibratory sounds, since they can be heard and understood in themselves by humans, they can be used for mobile telephone conversation as they are. Also, they can be used for mobile telephone conversation after they are processed into modified speech by morphing algorithm.

Furthermore, since speech recognition is possible by utilizing the Hidden Markov Model (hereinafter sometimes abbreviated to HMM) conventionally used for speech recognition and replacing the acoustic model of normal speech with the muscle-conducted vibratory sounds of non-audible murmurs, a sort of non-vocal recognition can be achieved, which can be used as a new input method for personal digital assistant terminals.

As described above, the present invention proposes non-audible murmurs as a new element of human-to-human and human-to-computer communication. Moreover, since it uses a contact portion which conducts non-audible murmurs from the skin surface to the condenser microphone, it is made possible to restrain the attenuation of the high frequency region attributable to mismatching of acoustic impedance and obtain the spectrum of bands at or above 2 kHz.

BEST MODES FOR CARRYING OUT THE INVENTION

Next, modes for carrying out the present invention will be described with reference to the drawings. In each drawing referenced in the following description, similar parts to any parts in other drawings will be designated by respectively the same signs.

Incidentally in the Japanese language, most vocalization uses the expiration in the respiratory process. Therefore, the following description will refer to cases in which the object is non-audible murmurs using the expiration, but implementation is similarly possible where the object is non-audible murmurs using the inspirations. Further, non-audible murmurs do not presuppose being heard by any other person. In this respect, they differ from whispers positively intended to be heard by others. And the present invention is characterized by the sampling of non-audible murmurs with a microphone by flesh-conduction without using air conduction.

(Mobile Telephone System)

Figure 1:
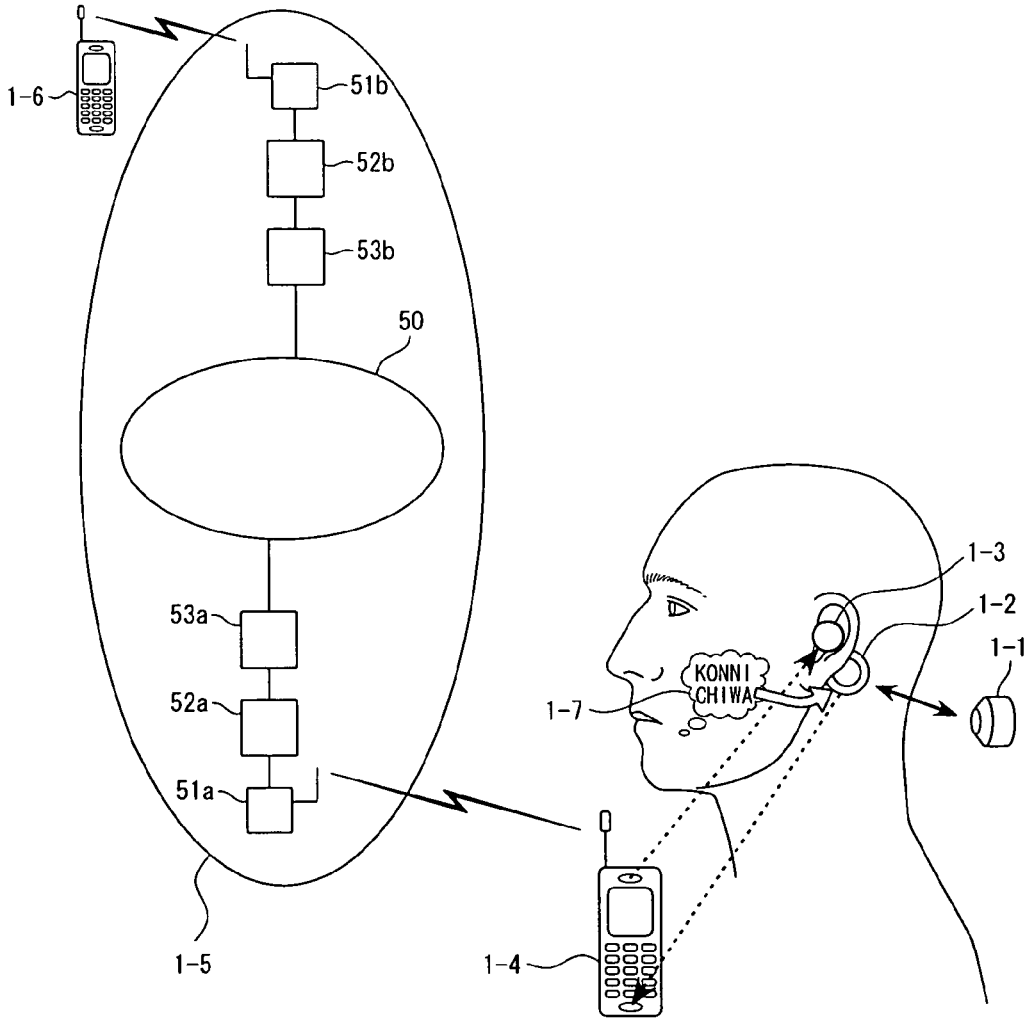
FIG. 1 is a block diagram showing the configuration of a communication interface system using a microphone according to the present invention when it is applied to a mobile telephone system.

FIG. 1 is a schematic configurational diagram of a communication interface system using a microphone according to the present invention.

A microphone 1-1 is fitted to a sub-mastoid part 1-2 by adhesion, and an earphone 1-3 or a loudspeaker is fitted to the ear hole. The microphone 1-1 is substantially cylindrical, and one of its bottom faces is provided with a contact portion to be described afterwards. The microphone 1-1 is used in a state in which this contact portion is in contact with the skin surface of the sub-mastoid part 1-2. The microphone 1-1 and the earphone 1-3 are connected to a mobile telephone 1-4 by wired or wireless means of communication. A loudspeaker may as well be used in place of the earphone 1-3.

A wireless network 1-5 comprises, for instance, wireless base stations 51*a* and 51*b*, base station control equipments 52*a* and 52*b*, exchanges 53*a* and 53*b*, and a communication network 50. In this example, wireless communication by the mobile telephone 1-4 with the wireless base station 51*a* and wireless communication by a mobile telephone 1-6 with the wireless base station 51*b* makes possible a conversation between the mobile telephone 1-4 and the mobile telephone 1-6.

Non-audible murmurs uttered by a human without using regular vibrations of the vocal cords are articulated by a variation in resonance filter characteristics associated with motions of articulatory organs including the tongue, lips, jaw and soft palate substantially similarly to speech uttered by regularly vibrating the vocal cords, and arrives at the sub-mastoid part 1-2 as muscular-conducted vibratory sounds.

The vibratory sounds of non-audible murmurs 1-7 having reached the sub-mastoid part 1-2 are sampled by the microphone 1-1 fitted there and converted into electric signals by a condenser microphone in the microphone, and these signals are transmitted to the mobile telephone 1-4 by wired or wireless means of communication.

The vibratory sounds of non-audible murmurs transmitted to the mobile telephone 1-4 are transmitted via the wireless network 1-5 to the mobile telephone 1-6 which the other party to communication has.

On the other hand, speech of the other party to communication is transmitted via the mobile telephone 1-6, the wireless network 1-5 and the mobile telephone 1-4, to the earphone 1-3 or the loudspeaker by wired or wireless means of communication. Incidentally, when listening directly to the mobile telephone 1-4, the earphone 1-3 is not needed.

This makes possible a communication with the other party to communication. Since on this occasion the non-audible murmurs 1-7 are uttered, the conversation is not heard by any other person within a radius of, for instance, 1 m. Not does it annoy any other person within a radius of 1 m.

In short, in this example, the microphone is combined with the mobile telephone as a signal processing device to constitute a communication interface system.

(Speech Recognition System)

Figure 2:
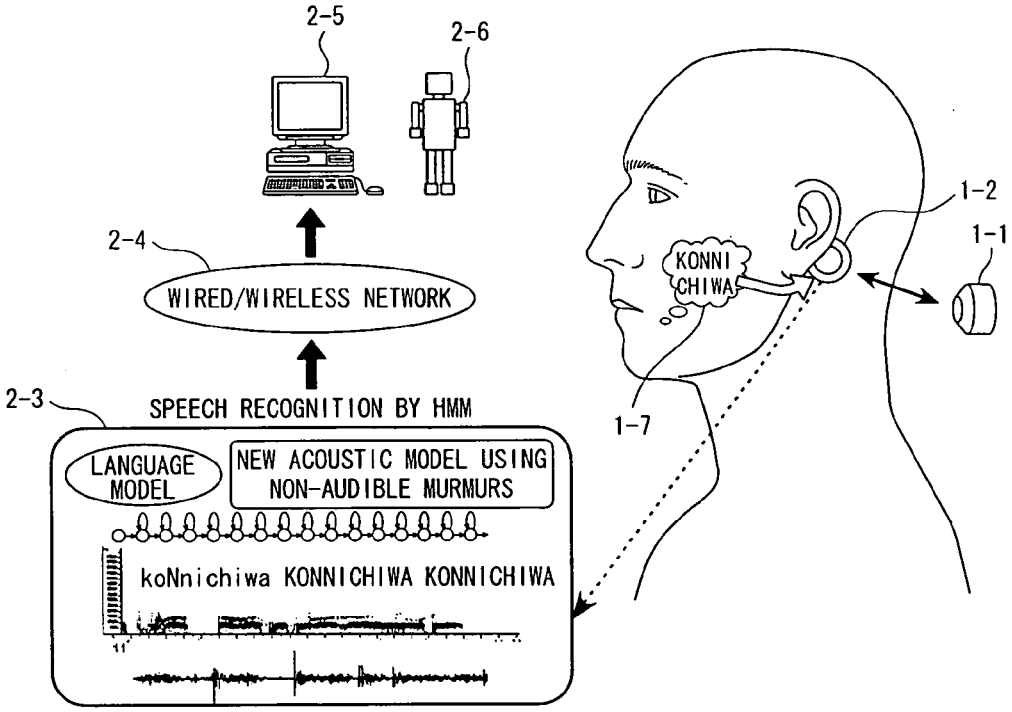
FIG. 2 is a block diagram showing the configuration of the communication interface system using the microphone according to the present invention when it is applied to a speech recognition system.

FIG. 2 is a schematic configurational diagram of a communication interface system using the microphone according to the present invention.

As in the case of FIG. 1, the microphone 1-1 is fitted to the body surface of the sub-mastoid part 1-2 of the skull downward behind the auricle by adhesion.

Non-audible murmurs 1-7 uttered by a human to say "koNnichiwa" (meaning "Hello") are articulated by variations in their resonance filter characteristics as a result of motions of articulatory organs including the tongue, lips, jaw and soft palate substantially similarly to speech uttered by regularly vibrating the vocal cords, and arrives at the sub-mastoid part 1-2 as muscular-conducted vibratory sounds.

The vibratory sounds of non-audible murmurs 1-7 "koNnichiwa" having reached the sub-mastoid part 1-2 are sampled by the microphone 1-1 and transmitted to a personal digital assistant terminal 2-3 by wired or wireless means of communication.

The vibratory sounds of non-audible murmurs "koNnichiwa" transmitted to the personal digital assistant terminal 2-3 undergo speech recognition as "koNnichiwa" by a speech recognizing function built into the personal digital assistant terminal 2-3.

The character sequence "koNnichiwa", which is the result of speech recognition, is transmitted to a computer 2-5 and a robot 2-6 among others via a wired/wireless network 2-4.

The computer 2-5, the robot 2-6 and so forth generate audio and video responses to it, and returns them via the wired/wireless network 2-4 to the personal digital assistant terminal 2-3.

The personal digital assistant terminal 2-3 utilizes the functions of speech synthesis and image displaying to output those items of information to a human.

Since non-audible murmurs are uttered in this process, the conversation is not heard by any other person even within a radius of 1 m.

In short, in this example, the microphone is combined with the personal digital assistant terminal as a signal processing device to constitute a communication interface system.

(Configuration of Microphone)

In order to enable minute vibrations propagating from the skin surface by flesh-conduction to be sensed, adaptation of the microphone, which is the sound collecting device, was indispensable first of all. In an experiment using a stethoscope having membrane for medical use, it was found that placing the stethoscope against a certain region of the head made respiratory sounds audible and, when motions joined them, the respiratory sounds of non-audible murmurs were articulated by the resonance filter characteristics of the vocal tract to make voices resembling murmurs audible and discernible like voices uttered by the use of regular vibrations of the vocal cords. For this reason, it was considered that a method applying the reverberations of the minute closed space of this stethoscope having membrane would be effective.

Figure 3:
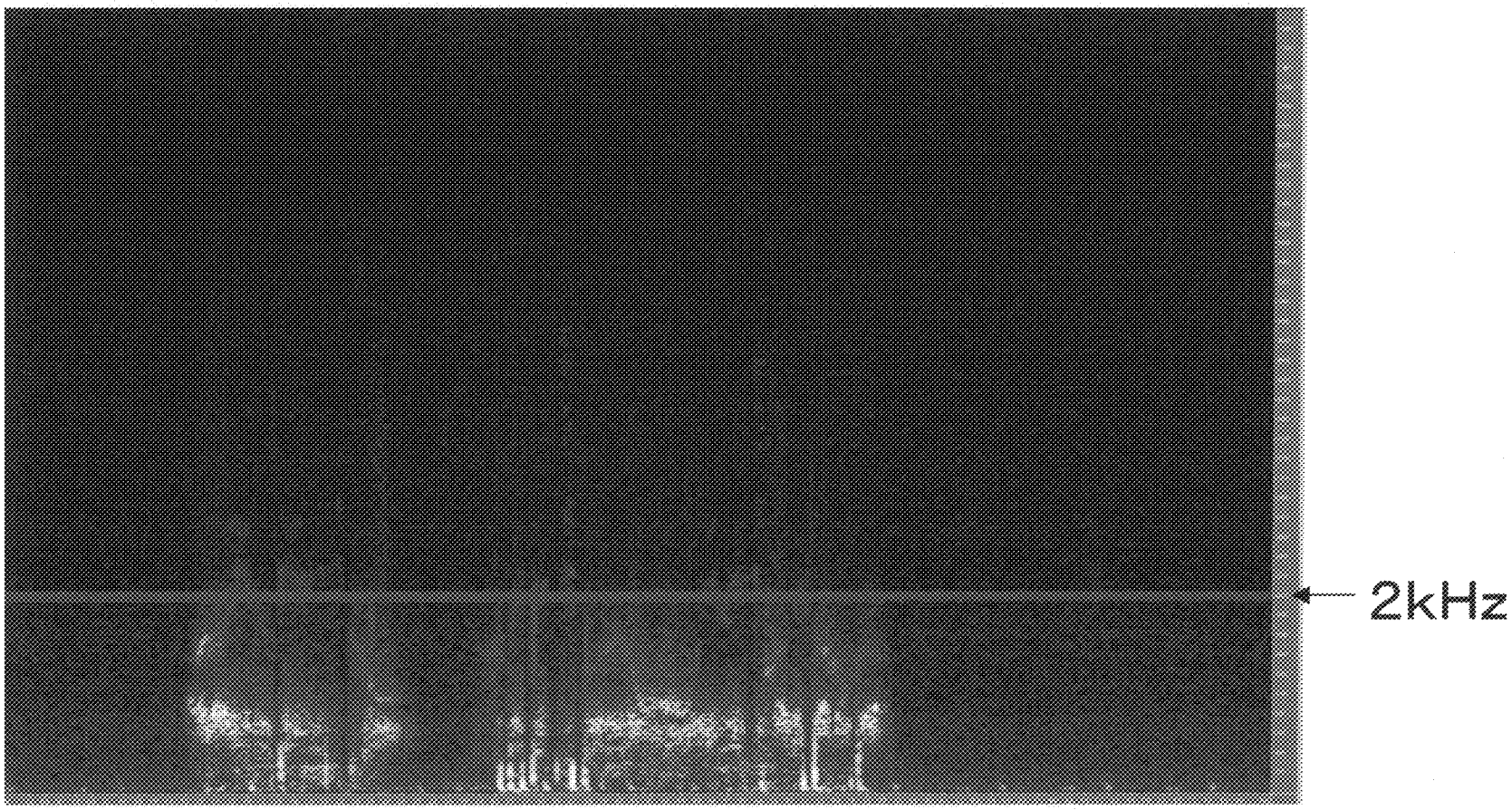
FIG. 3 is a diagram showing a spectrogram of a microphone for non-audible murmurs.

However, if any mismatching of acoustic impedance occurs on the interface between the skin surface over soft tissues in the body, which are mainly liquid, and the air space, which is gaseous, only a spectrum of below 2 kHz can be obtained as shown in FIG. 3 even if the microphone's own sensitivity is high enough. Or if the minute reverberating space is an air space, external noise can easily come in.

If it is possible to transmit the vibrations of non-audible murmurs from the skin directly to the diaphragm electrodes of the condenser microphone to reduce susceptibility to external noise, the aforementioned mismatching of acoustic impedance can be eliminated, and a spectrum of or above 2 kHz can conceivably obtained. It is considered likely that filling the minute reverberating space with biocompatible material having an acoustic impedance close to soft tissues in the body can meet this purpose. Materials having an acoustic impedance close to human soft tissues and excelling in biocompatibility include such gel elastic macromolecular compounds as silicone rubbers, polyether rubbers, polysulfide rubbers, alginates and agar.

Out of these materials, hardened silicone rubbers are often used to prepare a patterning model for preparing an intramouth model needed for prosthodontics (hereinafter referred to as impression material), and they are material whose hardness and elasticity can be easily adjusted.

More specifically, hardened silicone rubbers that can be used include organic peroxide-setting organo-polysiloxane compositions, addition reaction-setting organo-polysiloxane compositions and room temperature-setting organo-polysiloxane compositions.

An organic peroxide-setting organo-polysiloxane generally has the following composition as its main component.

(A) 100 weight parts of organo-polysiloxane represented by the following average composition formula (1):

$$R^4_nSiO_{(4-n)/2} \quad (1)$$

(where $R^4$ is a homo-substituted, hetero-substituted or non-substituted monovalent hydrocarbon group, and n is a positive number of 1.98 to 2.02).

(B) 1 to 100 weight parts of silica fine powder (C) Quantity of organic peroxide catalyst An addition reaction-setting organo-polysiloxane generally has the following composition as its main component.

(D) 100 weight parts of organo-polysiloxane represented by the following average composition formula (1):

$$R^4_nSiO_{(4-n)/2} \quad (1)$$

(where $R^4$ is a homo-substituted, hetero-substituted or non-substituted monovalent hydrocarbon group, and n is a positive number of 1.98 to 2.02) and containing at least two alkenyl groups in one molecule.

(E) 10 to 60 weight parts of silica fine powder (F) 1 to 60 weight parts of organo-hydrogen polysiloxane represented by the following average composition formula (2)

$$R^3_eH_fSiO_{(4-e-f)/2} \quad (2)$$

(where $R^3$ is a substituted monovalent hydrocarbon group of 1 to 10 in carbon number or non-substituted monovalent hydrocarbon; e and f are positive numbers satisfying the conditions that e is 0.7 to 2.1, f is 0.001 to 1.0 and e+f is 0.8 to 3.0).

(G) Quantity of catalyst for addition reaction

A room temperature-setting organo-polysiloxane generally has the following composition as its main component.

(H) 100 weight parts of diorgano-polysiloxane represented by the following average composition formula (3)

$$HO[Si(R^1)_2O]_nH \quad (3)$$

(where $R^1$ is a non-substituted or substituted hydrocarbon group, and n is a positive number not less than 15).

(I) 0.1 to 20 weight parts of organo-silane represented by the following average composition formula (4) or a partial hydrolysate thereof:

$$(R^2)_mSi(OR^2)_{4-m} \quad (4)$$

(where $R^2$ is an independently non-substituted or substituted hydrocarbon group, and m is 0, 1 or 2).

(J) 1 to 100 weight parts of silica fine powder (K) Quantity of room temperature-setting catalyst As the inorganic filler for hardened silicone rubber, any one suitable for the purpose can be selected out of quartz, cristobalite, diatomaceous earth, molten quartz, glass fibers, titanium dioxide and magnesium silicate in addition to silica fine powder mentioned above.

Figure 4:
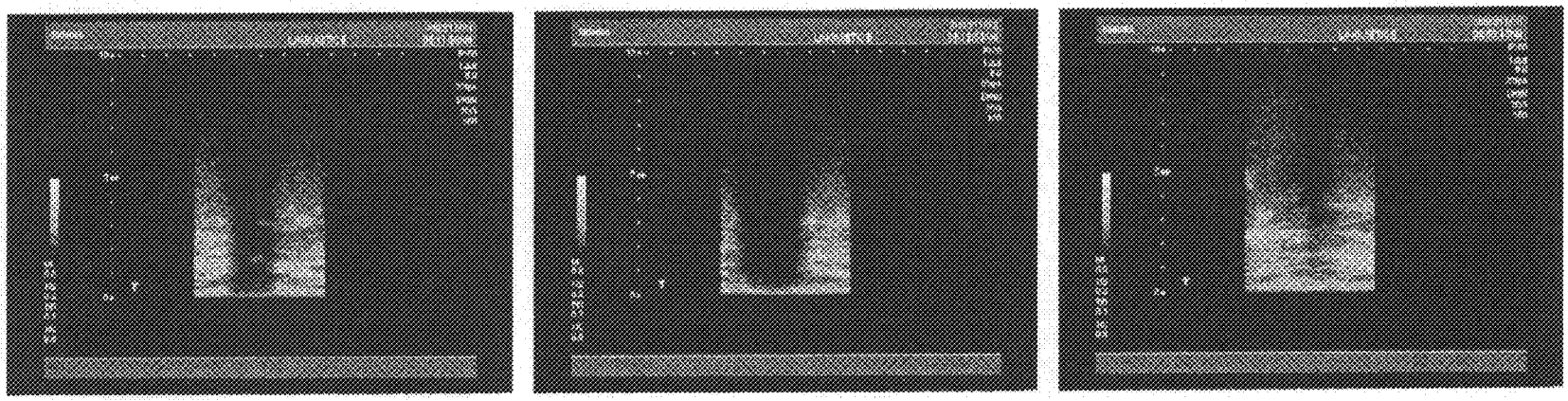
FIG. 4 is a diagram showing examples of measurement of acoustic impedance due to ultrasonic imaging.

The present inventor placed three kinds of hardened silicone rubber differing in hardness against the abdominal wall as shown in FIG. 4, and observed differences in acoustic impedance between hardened silicone rubber and the abdominal wall with an ultrasonic imaging device. "Soft silicone" in the diagram refers to the characteristic of hardened silicone rubber close to the softness of human soft tissues. In the same diagram, hardened silicone rubber harder than "soft silicone" is referred to as "elastic silicone" and still harder hardened silicone rubber, as "hard silicone". As is seen from the diagram, what had an acoustic impedance close to human soft tissues was found to be the "soft silicone" whose softness is close to that of human soft tissues. Evident dark shadows could be observed in "elastic silicone" and "hard silicone", revealing substantial reflection of ultrasonic waves by the surface of the hardened silicone rubber due to mismatching of acoustic impedance.

Then, by selecting soft silicone rubber and filling the minute reverberating space with it, the flesh conducted sounds of non-audible murmurs will be conducted by the soft silicone rubber having an acoustic impedance of soft tissues which is close to that of the human body, and conceivably can be obtained by the condenser microphone without causing mismatching of acoustic impedance.

It is preferable for the viscosity of the silicone rubber composition at 23° C. to be not less than 100 cP, normally 100 to 10,000,000 cP, and particularly 1,000 to 10,000 cP. It is preferable to use an addition reaction-setting organo-polysiloxane as hardened silicone rubber, the preferable range of (E) Silica fine powder is 10 to 60 weight parts, and the preferable range of (F) organo-hydrogen polysiloxane is 1 to 60 weight parts. Incidentally, it is preferable for the hardness of the hardened silicone rubber to be not more than 30(Shore A).

Further, since a soft gel substance, because of its high plasticity, has an advantage of being deformed to eliminate any gap and drive out air when brought into contact with the skin, it serves to avoid the aforementioned problem of acoustic impedance mismatching due to residual air. In addition, a soft gel substance has a silencing effect of absorbing the sizzling contact noise.

Figure 5:
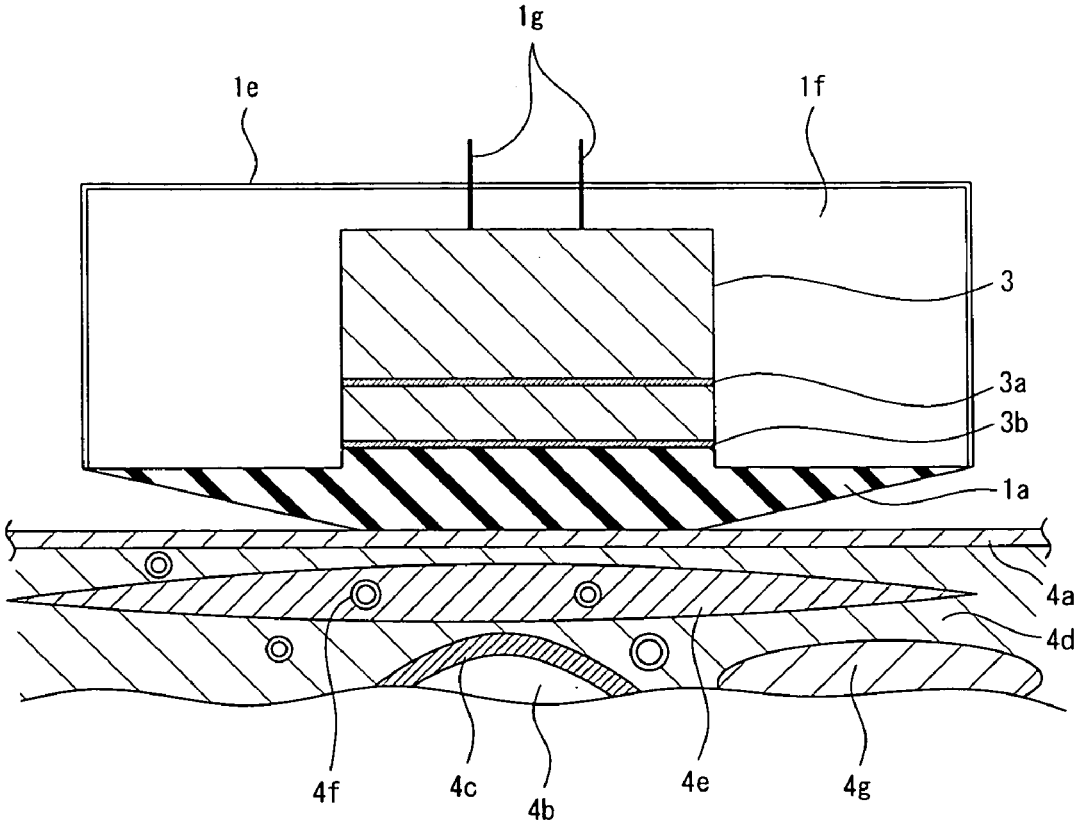
FIG. 5 is a sectional view showing the configuration of a microphone, which is a first embodiment of the present invention.

FIG. 5 is a sectional view showing the configuration of a first embodiment of the microphone 1-1, which constitutes the essential part of the present invention. The microphone 1-1 shown in the diagram has a configuration in which a contact portion 1*a* of hardened soft silicone rubber is provided in the sound collecting portion of a condenser microphone part 3, and other parts of the condenser microphone part 3 than the sound collecting portion are housed in a hard frame 1*e*.

The condenser microphone part 3 has two diaphragm electrodes 3*a* and 3*b*, and leads 1*g* for leading out the received vibratory sounds as electric signals.

The contact portion 1*a* of hardened soft silicone rubber is the portion which comes into contact with the surface of a skin 4*a*, and in this example it is so shaped that its sectional area becomes gradually smaller from the condenser microphone part 3 toward the surface of the skin 4*a*. This shape can be realized by preparing a mold of that shape at the beginning and injecting silicone rubber material together with a hardening accelerator into the prepared mold. By using the contact portion 1*a* of such a shape, secure contact with the appropriate region of the skin surface in the sub-mastoid part and non-audible murmurs can be securely conducted.

Air is present in an external noise preventing space 1*f* between the frame 1*e* and a condenser microphone part 3. By surrounding the condenser microphone part 3 with the hard frame 1*e* and disposing the external noise preventing space 1*f*, external noise can be prevented from coming in. To add, a hard material such as resin can be used as the material of the frame 1*e*.

The skin 4*a* is the skin over the sternocleidomastoid muscle immediately below the mastoid of the skull, that is, in the lower part of the skin behind the auricle. Within this skin 4*a* there are an oral cavity 4*b*, mucus 4*c*, a connective tissue/fat 4*d*, a muscle 4*e*, a blood vessel 4*f* and a bone 4*g*.

The use of such a configuration results in the presence of the contact portion 1*a* between the diaphragm electrode 3*b*, which is one of the two diaphragm electrodes constituting the condenser microphone part 3, and the surface of the skin 4*a*. And this contact portion 1*a* conducts non-audible murmurs from the oral cavity 4*b* to the condenser microphone part 3. As the contact portion 1*a* in this example is formed of hardened soft silicone rubber having an acoustic impedance close to that of soft tissues in the body, when non-audible murmurs are conducted, attenuation of the high frequency region due to acoustic impedance mismatching can be restrained.

Figure 6:
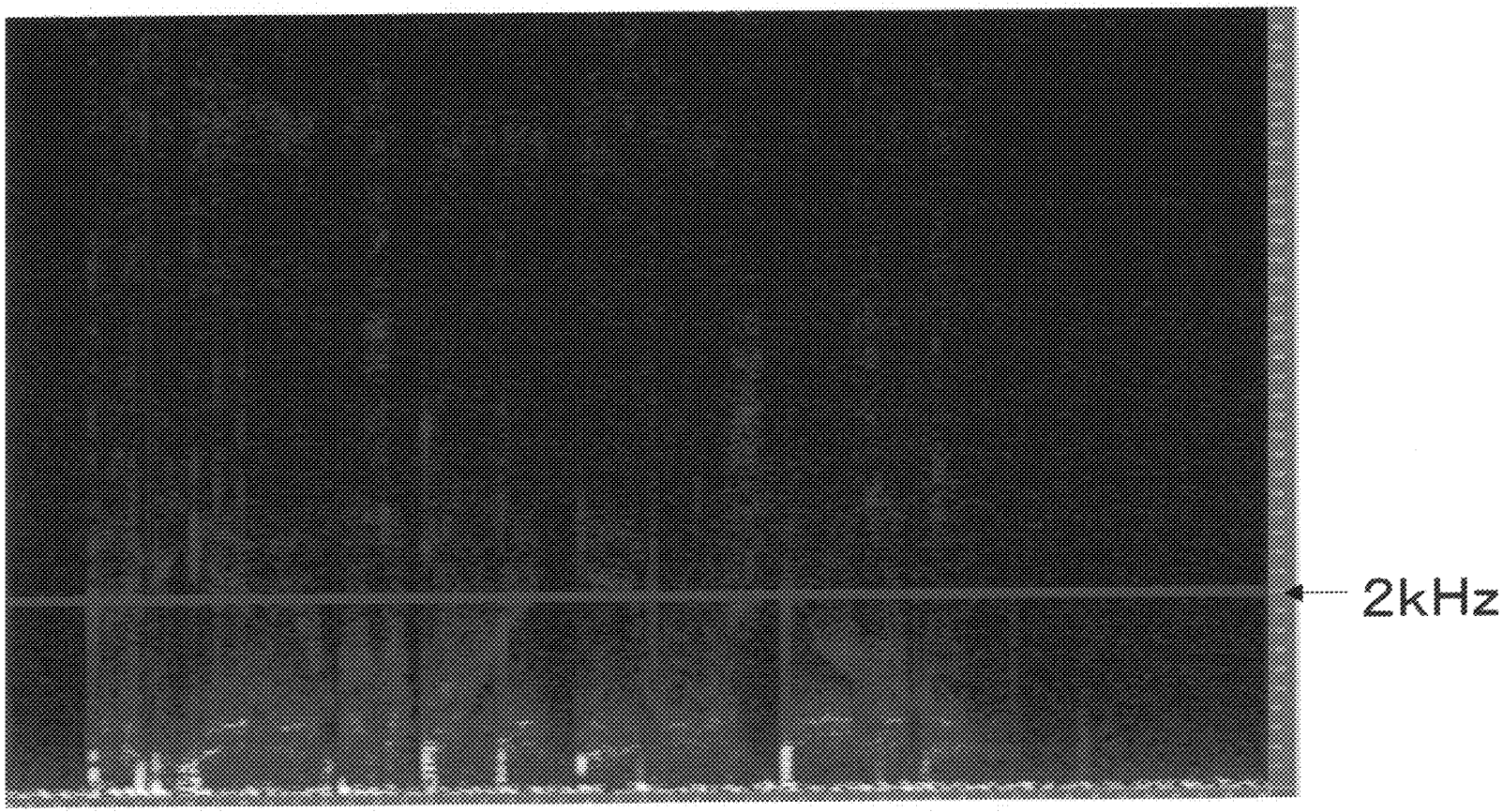
FIG. 6 is a diagram showing a spectrogram of the microphone of FIG. 5.

FIG. 6 is a diagram showing a spectrogram regarding the hardened silicone rubber-conducting type condenser microphone of FIG. 5. This diagram reveals that a spectrum of or above 2 kHz is obtained as aimed at.

Figure 7:
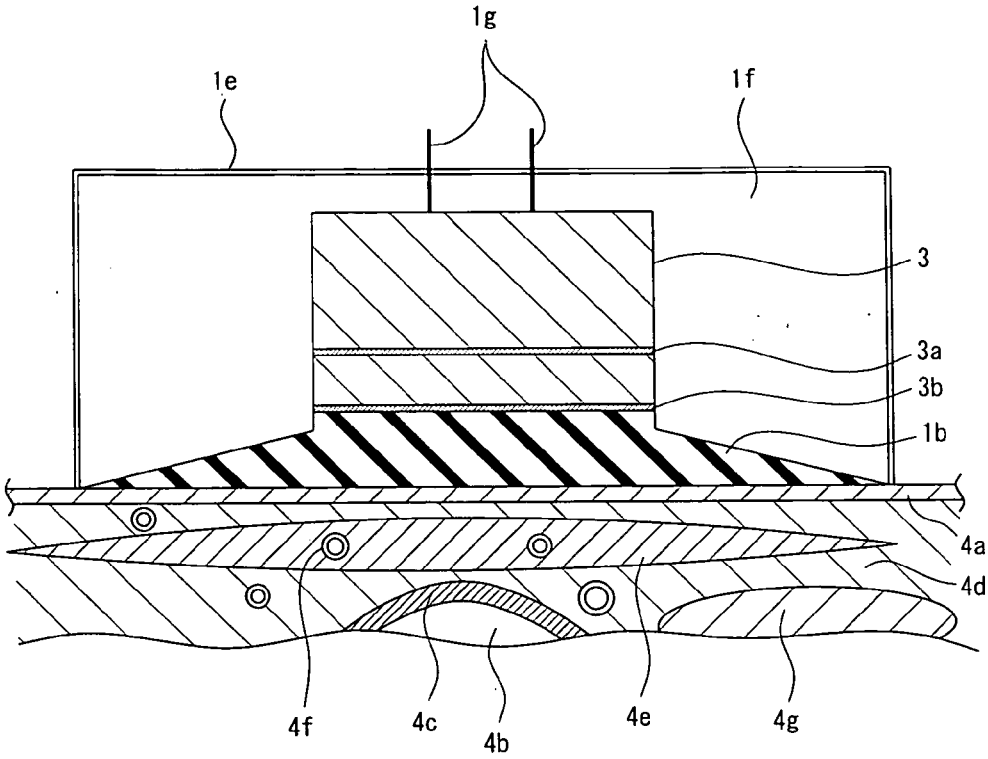
FIG. 7 is a sectional view showing the configuration of a microphone, which is a second embodiment of the present invention.

FIG. 7 is a sectional view showing the configuration of a second embodiment of the microphone 1-1. The difference of the microphone 1-1 according to the second embodiment shown in the diagram from the first embodiment shown in FIG. 5 is that the sectional area of a substantially disk-shaped contact portion 1*b* of hardened soft silicone rubber gradually enlarges from the condenser microphone part 3 toward the surface of the skin 4*a*. The contact portion 1*b* of this shape can be realized by preparing a mold of that shape at the beginning and injecting silicone rubber material together with a hardening accelerator into the prepared mold. By using the contact portion 1*b* of such a shape, non-audible murmurs conducted by soft tissues in the body can be obtained in a greater amplitude even if a condenser microphone of the same size is used because the area of contact with the skin surface is greater.

Figure 8:
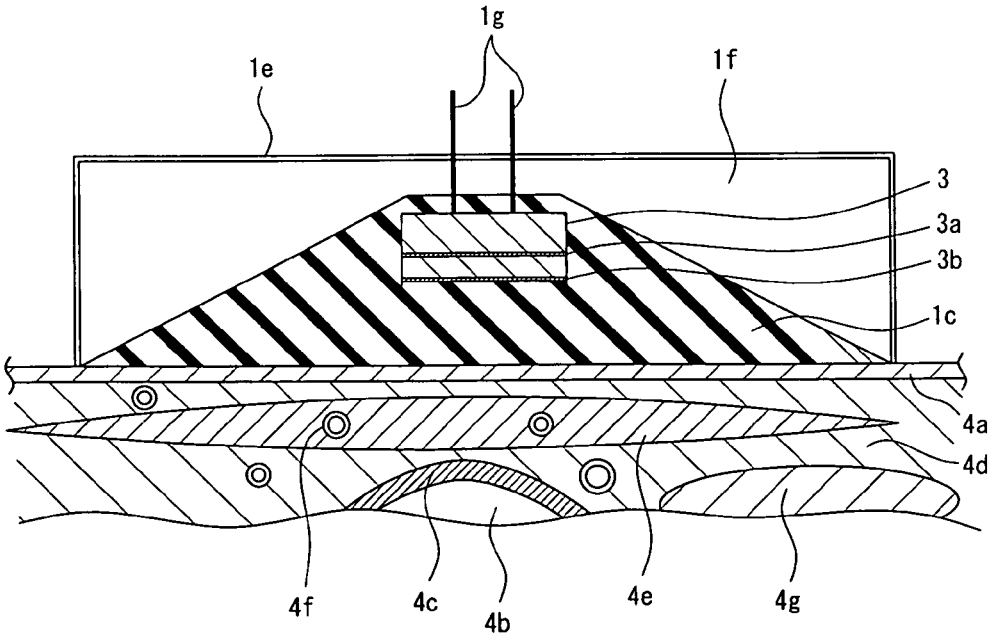
FIG. 8 is a sectional view showing the configuration of a microphone, which is a third embodiment of the present invention.
Figure 9:
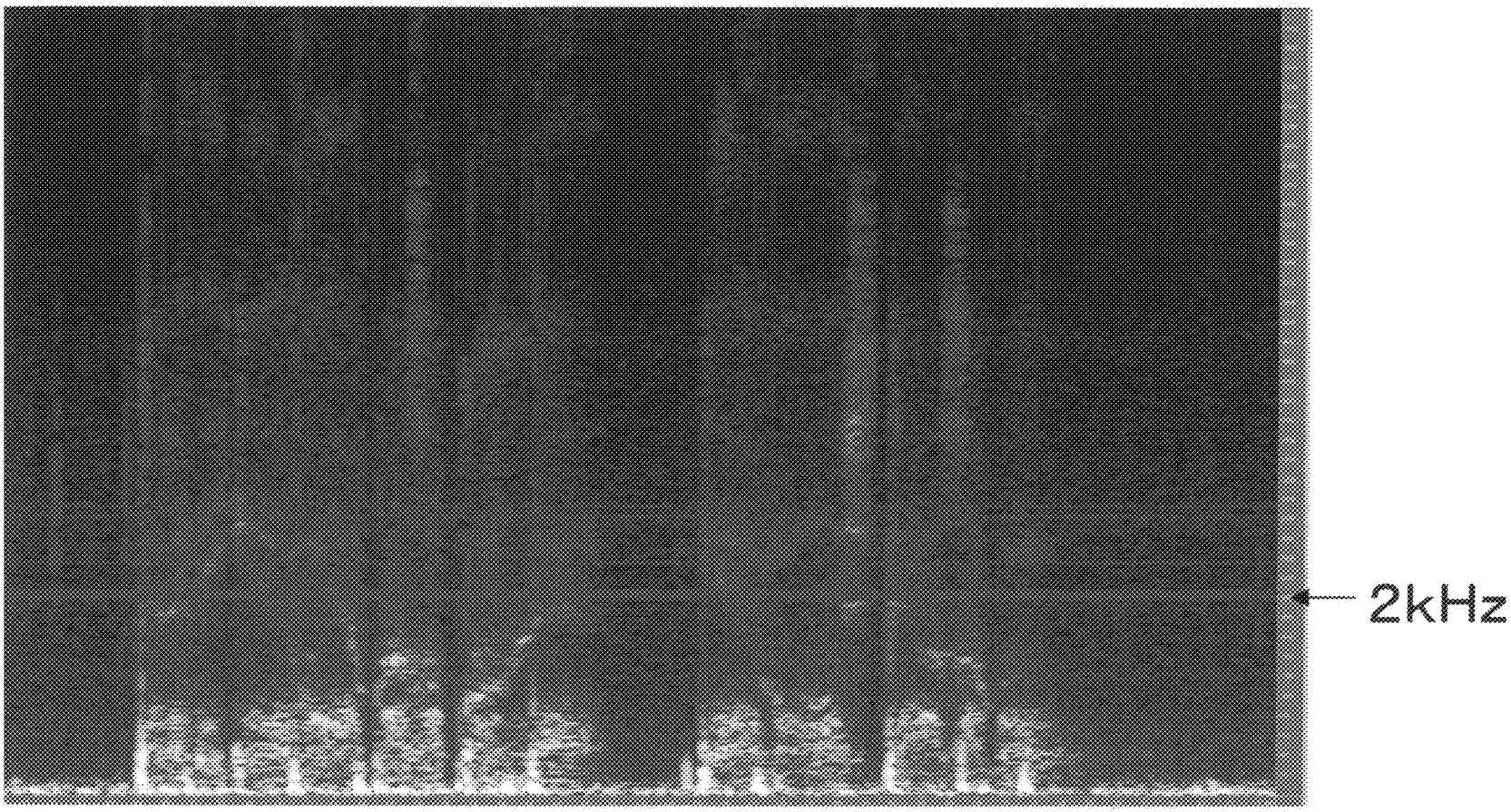
FIG. 9 is a diagram showing a spectrogram of the microphone of FIG. 8.

FIG. 8 is a sectional view showing the configuration of a third embodiment of the microphone 1-1. The difference of the microphone 1-1 according to the third embodiment shown in the diagram from the first embodiment shown in FIG. 5 and from the second embodiment shown in FIG. 7 is that the whole condenser microphone part 3 has a configuration of being submerged in a contact portion 1*c* of hardened soft silicone rubber. The contact portion 1*c* of this conic shape without the apex part can be realized by preparing a mold of that shape at the beginning, placing the condenser microphone part 3 within the prepared mold, and injecting silicone rubber material together with a hardening accelerator from above. By using the contact portion 1*c* of such a shape, non-audible murmurs conducted by soft tissues in the body can be obtained in a greater amplitude even if a condenser microphone of the same size is used because the area of contact with the skin surface is greater. Furthermore, as the whole condenser microphone is completely submerged in hardened soft silicone rubber, external noise can be even more securely prevented from coming in than in the case of the second embodiment shown in FIG. 7. FIG. 9 is a diagram showing a spectrogram that can be obtained by this embodiment. As shown in the diagram, a spectrum of or above 2 kHz is obtained.

Figure 10:
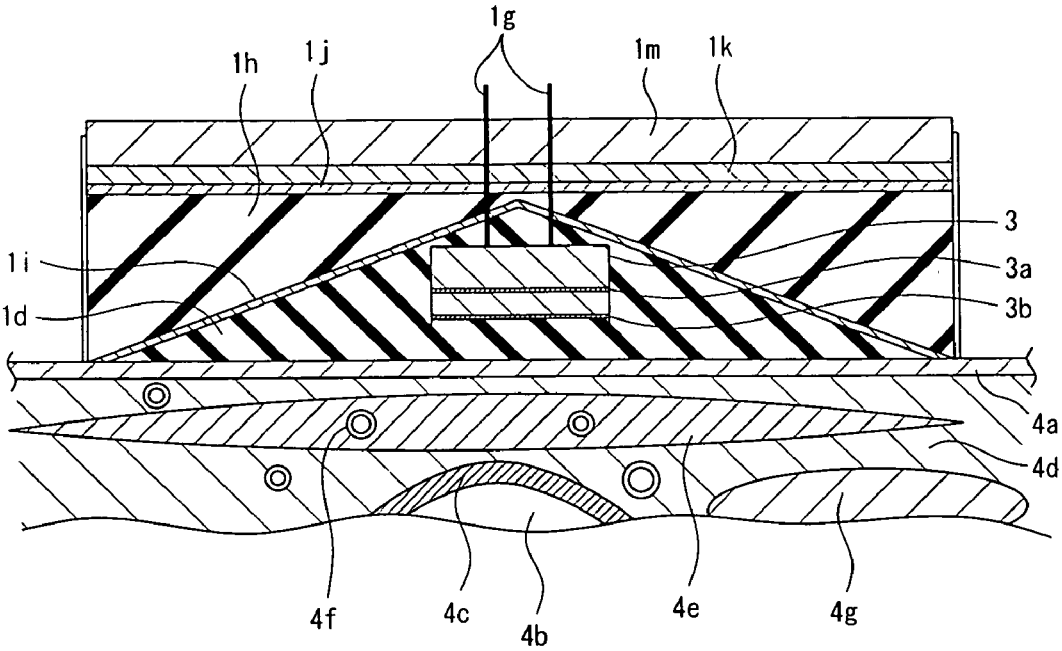
FIG. 10 is a sectional view showing the configuration of a microphone, which is a fourth embodiment of the present invention.

FIG. 10 is a sectional view showing the configuration of a fourth embodiment of the microphone 1-1.

The differences of the microphone 1-1 according to the fourth embodiment shown in the diagram from the third embodiment shown in FIG. 8 are that a reinforcing portion 1*h* is disposed around a substantially conically shaped contact portion 1*d* of hardened soft silicone rubber and a reflecting plate 1*i* is further provided on the interface between the contact portion 1*d* and the reinforcing portion 1*h*. Also, an absorber 1*j* and an absorber 1*k* to absorb vibrations are stacked in that order over the reinforcing portion 1*h*. And the whole configuration described above is covered by a reflector 1*m* which reflects vibrations.

The absorber 1*j* is supposed to be, for instance, a lead-made plate. The absorber 1*k* is supposed to be a plate made of special synthetic rubber for use in preventing AV (audio-visual) items from vibration. The reflector 1*m* is formed of resin.

The reflecting plate 1*i* is formed of, for instance, a metal. This reflecting plate 1*i* acts as a reflector to reflect non-audible murmurs conducted by the contact portion 1*d*.

Figure 11:
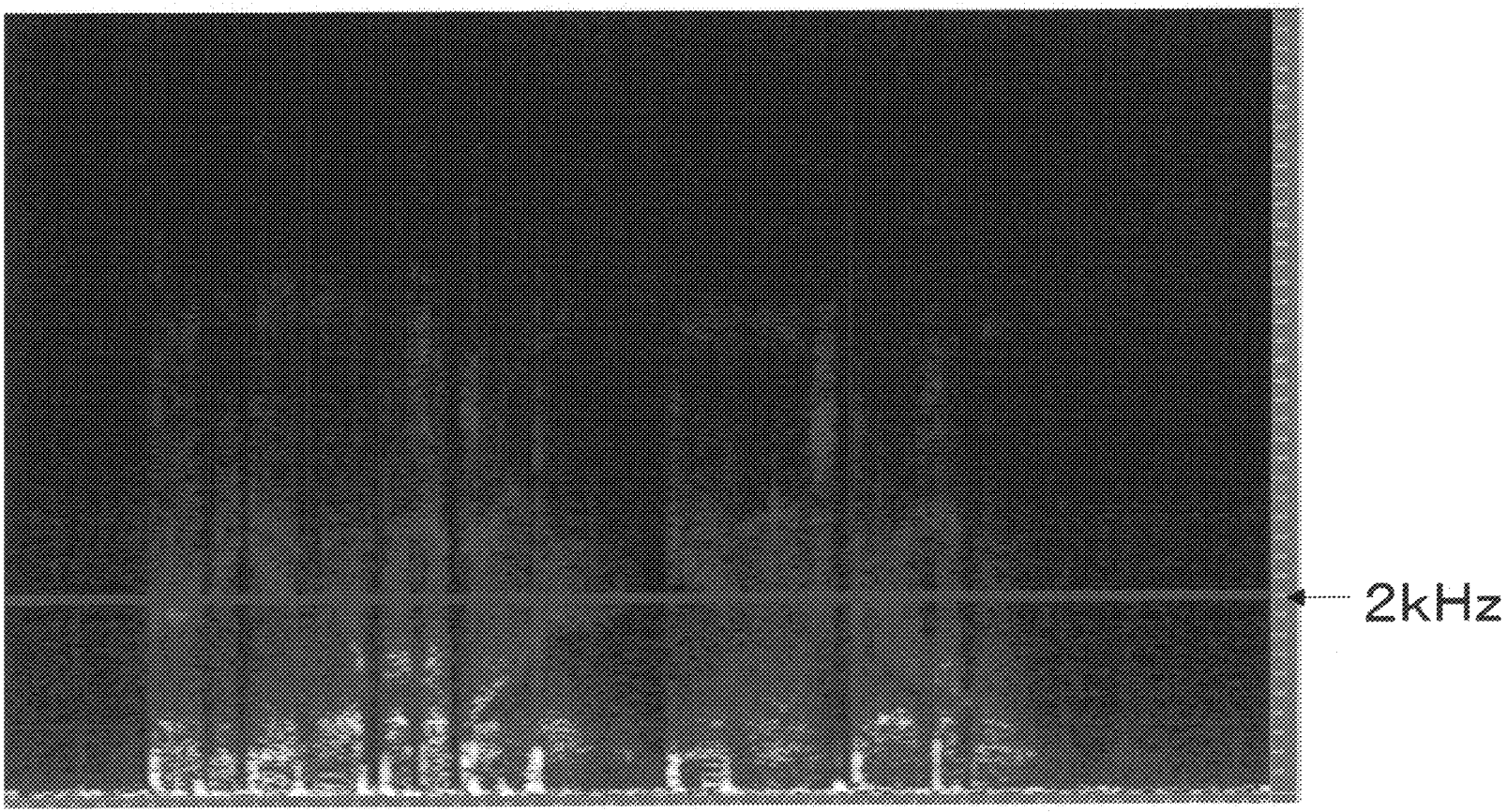
FIG. 11 is a diagram showing a spectrogram of the microphone of FIG. 10.

According to the configuration shown in the diagram, the reinforcing portion 1*h* of hardened hard silicone rubber is disposed in the part which is the external noise preventing space in the third embodiment, and the metallic reflecting plate 1*i* is disposed on the boundary between the contact portion 1*d* of hardened soft silicone rubber and the reinforcing portion 1*h* of hardened hard silicone rubber. Such a configuration causes non-audible murmurs conducted from soft tissues in the body to the contact portion 1*d* to be reflected inward on the internal face of the reflecting plate 1*i* and to concentrate on the portions of the diaphragm electrodes 3*a* and 3*b* of the condenser microphone part 3. Therefore, the non-audible murmurs can be obtained in a greater amplitude. FIG. 11 is a diagram showing a spectrogram that can be obtained by this embodiment. As shown in the diagram, a spectrum of or above 2 kHz is obtained.

Figure 12:
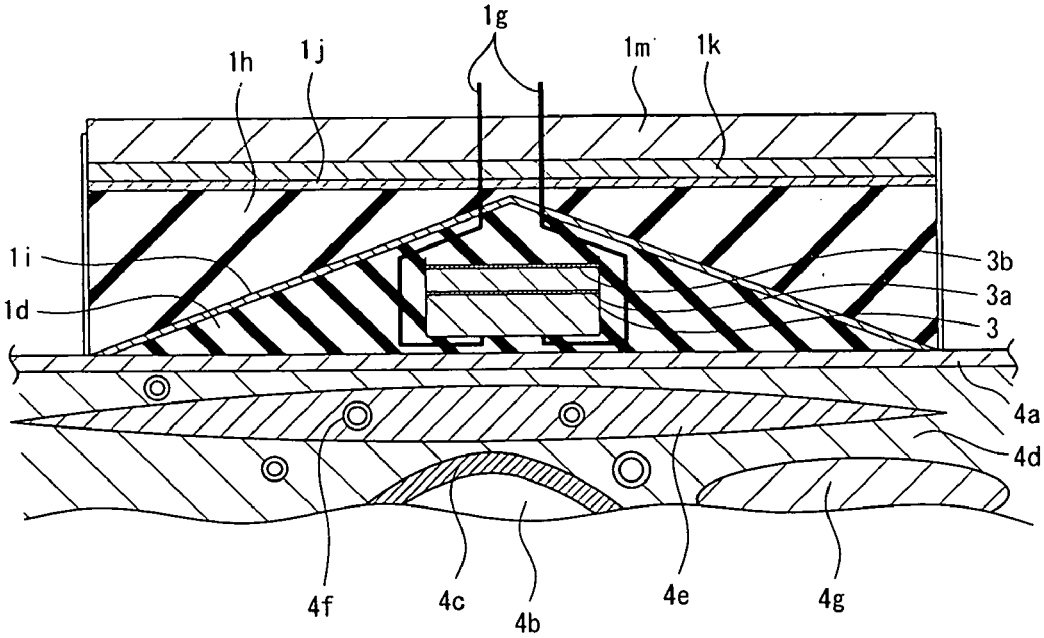
FIG. 12 is a sectional view showing the configuration of a microphone, which is a fifth embodiment of the present invention.

FIG. 12 is a sectional view showing the configuration of a fifth embodiment of the microphone 1-1.

The difference of the microphone 1-1 according to the fifth embodiment shown in the diagram from the fourth embodiment shown in FIG. 10 is that the condenser microphone part 3 is turned upside down and the diaphragm electrode 3*b* is disposed in a closer position to the reflecting plate 1*i* than the diaphragm electrode 3*a*. Such a configuration causes non-audible murmurs conducted by soft tissues in the body to be reflected inward on the internal face of the reflecting plate 1*i* and to concentrate on the diaphragm electrodes 3*a* and 3*b* of the condenser microphone part 3, with the result that the non-audible murmurs can be obtained in a greater amplitude. By this embodiment, too, a spectrum of or above 2 kHz can be obtained.

Figure 13:
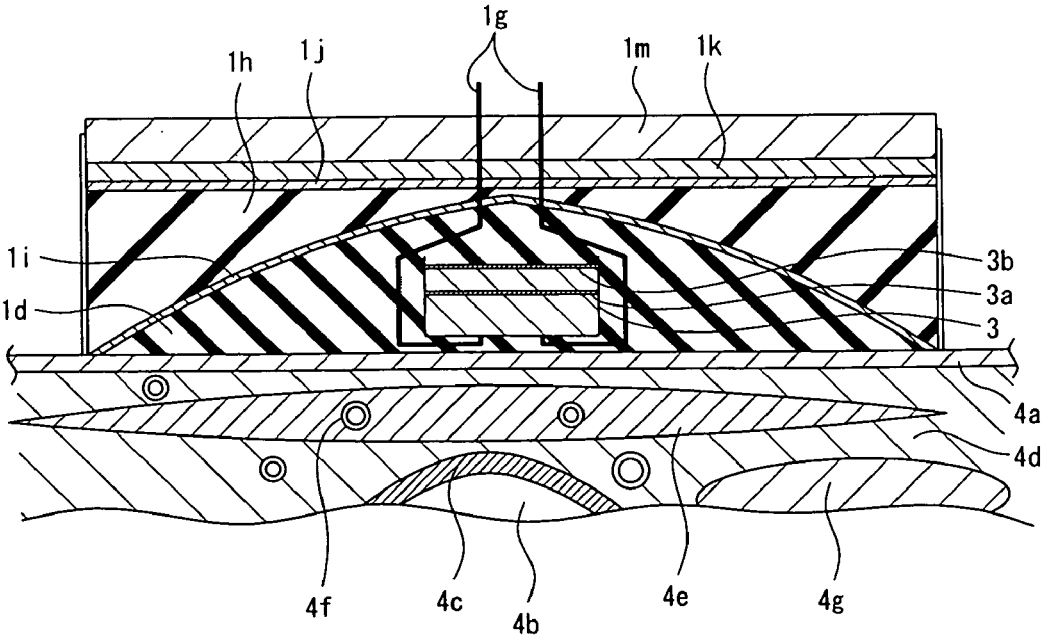
FIG. 13 is a sectional view showing the configuration of a microphone, which is a sixth embodiment of the present invention.

FIG. 13 is a sectional view showing the configuration of a sixth embodiment of the microphone 1-1.

The difference of the microphone 1-1 according to the sixth embodiment shown in the diagram from the fifth embodiment shown in FIG. 12 is that the internal face of the metallic reflecting plate 1*i* has the shape of a parabola antenna, namely a shape following a parabola. Shaping the internal face of the reflecting plate 1*i* in such a way can cause non-audible murmurs reflected inward on the internal face of the reflecting plate 1*i* to concentrate more intensely on the portions of the diaphragm electrodes 3*a* and 3*b* of the condenser microphone part 3. As a result, non-audible murmurs can be obtained in a greater amplitude. By this embodiment, too, a spectrum of or above 2 kHz can be obtained.

Figure 14:
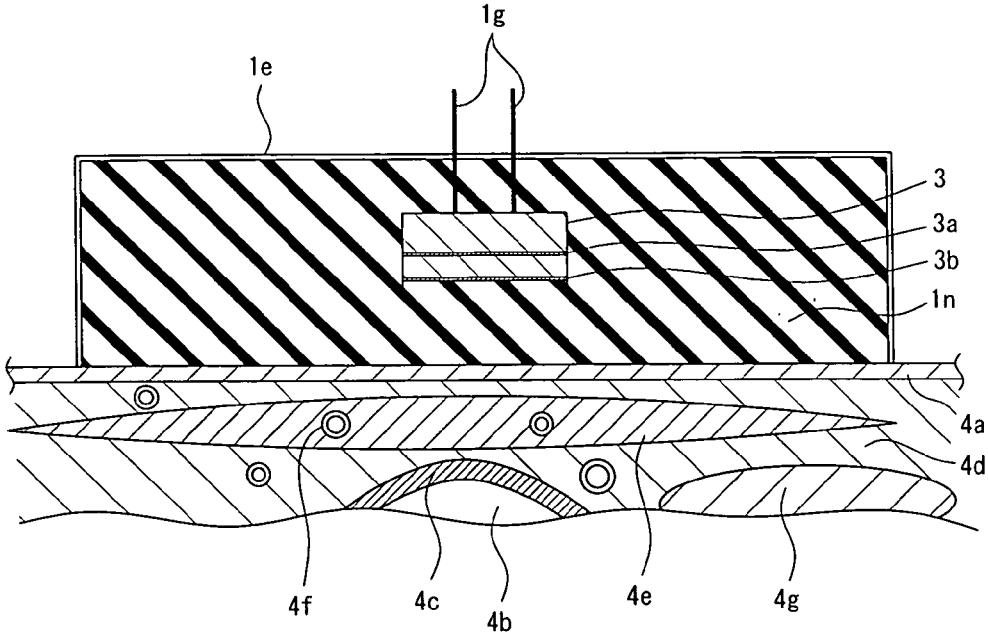
FIG. 14 is a sectional view showing the configuration of a microphone, which is a seventh embodiment of the present invention.

FIG. 14 is a sectional view showing the configuration of a seventh embodiment of the microphone 1-1.

Figure 15:
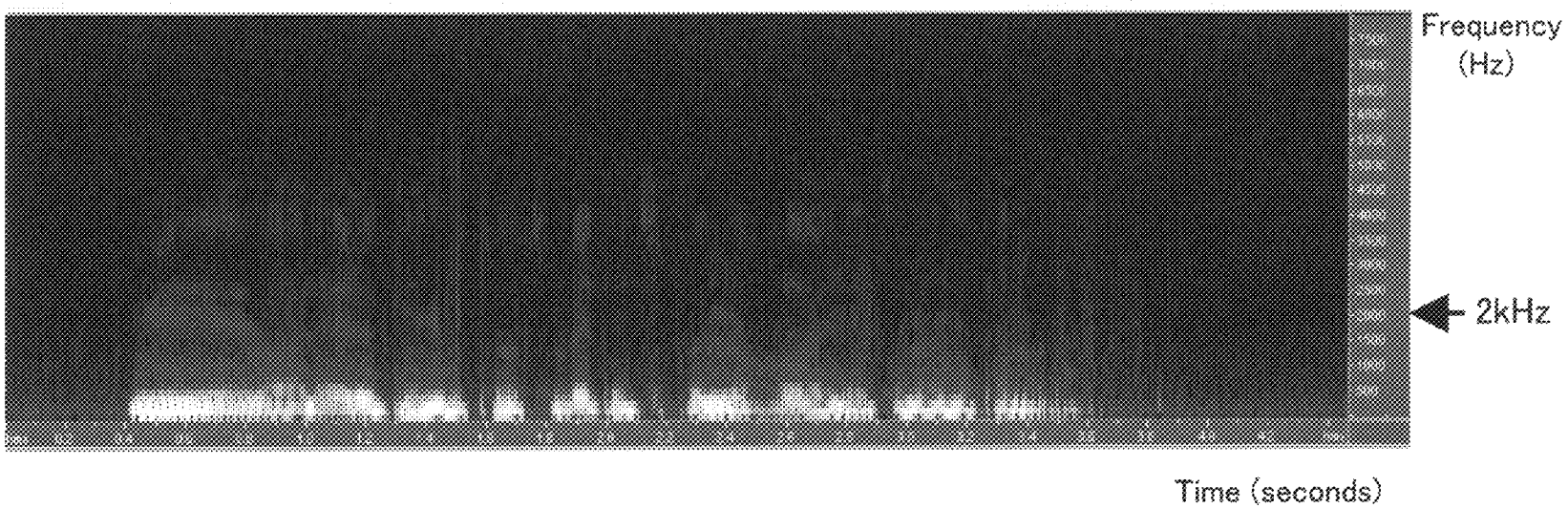
FIG. 15 is a diagram showing a spectrogram of the microphone of FIG. 14.

The difference of the microphone 1-1 according to the seventh embodiment shown in the diagram from the third embodiment shown in FIG. 8 is a configuration in which the same hardened soft silicone rubber as the contact portion also fills the external noise preventing space 1*f* and the whole condenser microphone part 3 is submerged in a contact portion in. Thus, the hardened silicone rubber not only covers the condenser microphone part 3 but also fills the whole inside of the microphone 1-1. Since the configuration of this seventh embodiment dispenses with the conic shape without the apex part required when the third embodiment is to be realized, molding is made easier, and accordingly the microphone 1-1 can be realized at less cost.

Where the shape of a microphone can be maintained with only the contact portion in of hardened soft silicone rubber, the frame 1*e* is unnecessary. As shown in FIG. 15, this embodiment can also obtain a spectrum of or above 2 kHz. Incidentally, the diagram shows spectral data of pronouncing a sentence "Arayuru genjitsu wo subete jibun no houe nejimagetanoda (meaning "Every reality has been distorted toward him")."

Figure 16:
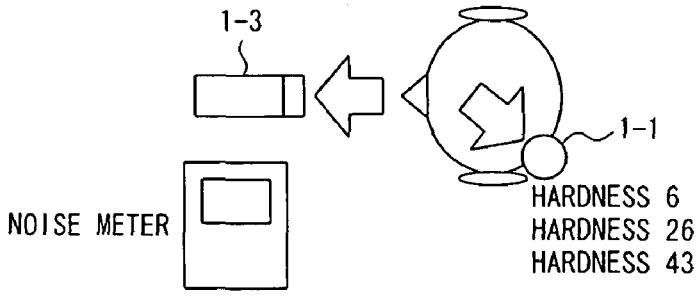
FIG. 16 is a diagram showing a method of studying a hardness of high sensitivity regarding the contact portion of the microphone of FIG. 14.

Incidentally, the present inventor searched for a hardness which would give high sensitivity to the contact portion 1*n* of the microphone shown in FIG. 14. In this search, he prepared contact portions in differing in hardness. In this example, three kinds of contact portions in of hardness 6, hardness 26 and hardness 43, and the microphone 1-1 was fitted to the body surface of the sub-mastoid part 1-2 of the skull downward behind the auricle as shown in FIG. 16 in the same way as in the case of FIG. 1.

Also in addition to the microphones 1-1 having contact portions 1*n* having three different levels of hardness, a standard microphone 1-7 was made ready and installed in front of the wearer. As the standard microphone 1-7, a microphone for measuring manufactured by Ono Sokki Co. was used. And when "a", "i" and "u" were so pronounced that the input level of a noise meter points to about 60 dB(A), the input levels of the standard microphone 1-7 and the microphone 1-1 were compared. The comparison was made by setting the input level of the standard microphone 1-7 to 0 dB and the input levels of the microphones 1-1 having the three different contact portions in were normalized and compared.

Figure 17:
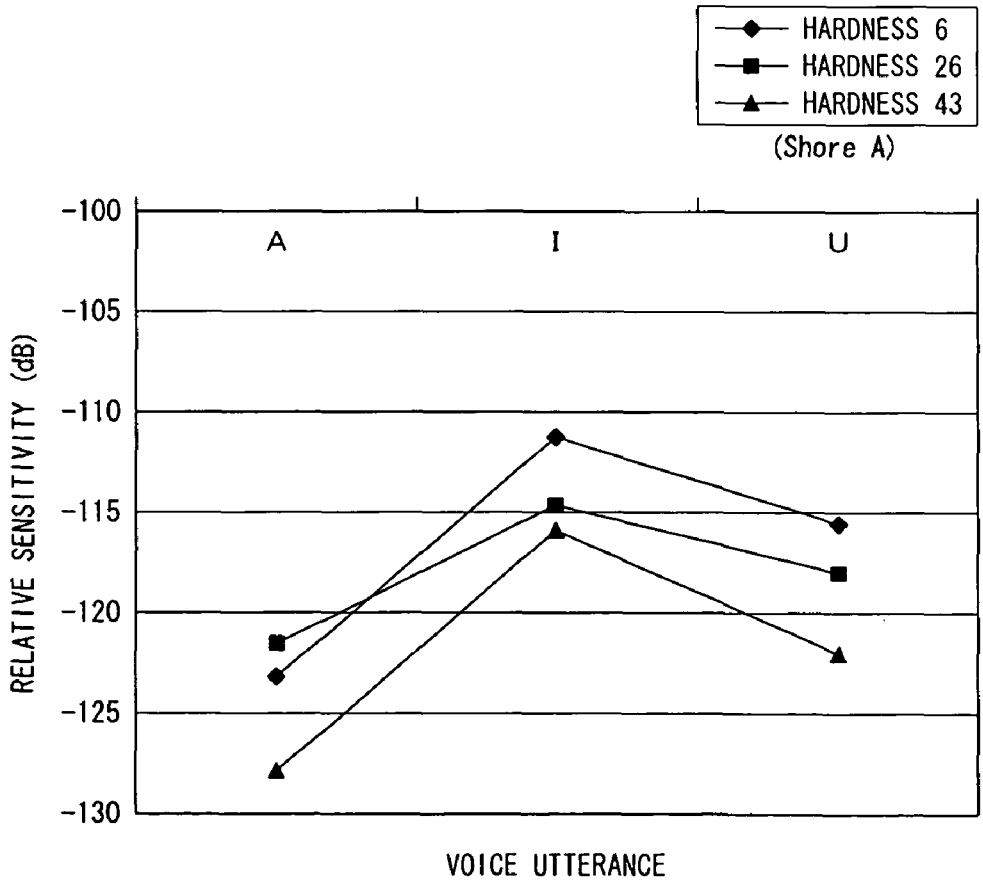
FIG. 17 is a diagram showing results of study by the method of studying shown in FIG. 16.

The results of this comparison are shown in FIG. 17. Referring to the diagram, it is seen that in every one of the pronunciations of "a", "i" and "u" the relative sensitivity is high in the case of hardness 6. The relative sensitivity is also high, next highest, in the case of hardness 26. Because of these findings, it seems that a high sensitivity can be obtained at or below hardness 30 approximately.

The microphones of the first through seventh embodiments configured as described are light in weight and inexpensive. As they cover the ears less than the headphones of a mobile music playback device, their fitting does not particularly bother the wearer.

(Fitting Position of Microphone)

Figure 18:
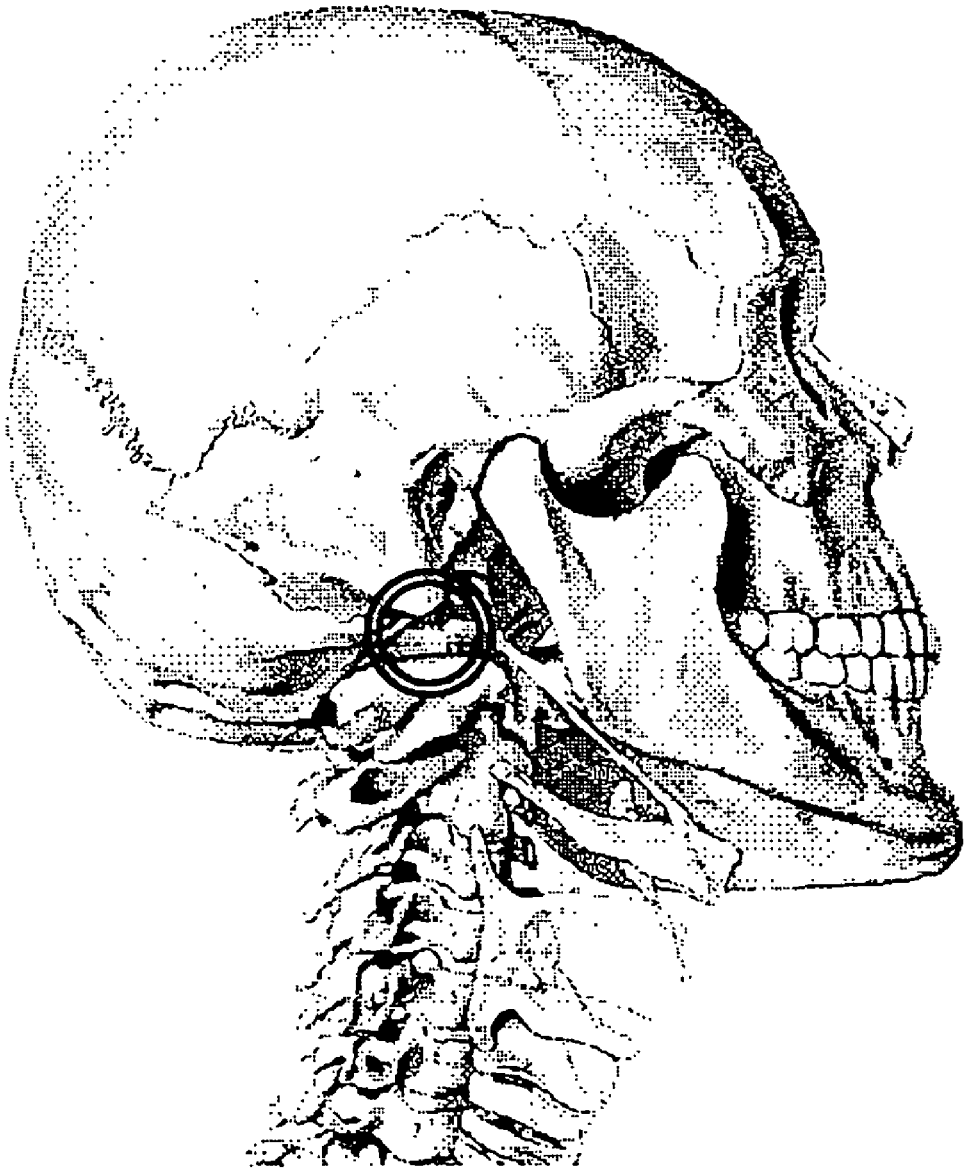
FIG. 18 is a diagram showing a fitting position of a microphone according to the present invention.
Figure 19:
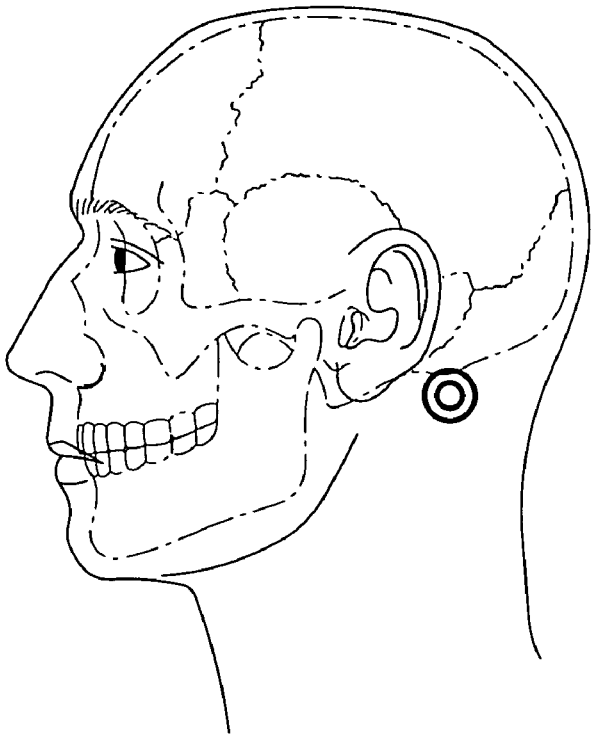
FIG. 19 is a diagram showing a fitting position of a microphone according to the present invention.

Next the fitting position of the microphone is the position marked with double circles in FIG. 18 and FIG. 19.

EXAMPLES OF APPLICATION

Whereas the foregoing description referred to cases in which the microphone alone is fitted the sub-mastoid part, this exposes the microphone outside and accordingly would look awkward. In view of this point, the microphone may as well be configured integrally with a head wearing object to be fitted to the human head, such as spectacles, headphones, earphone, cap or helmet.

Figure 20:
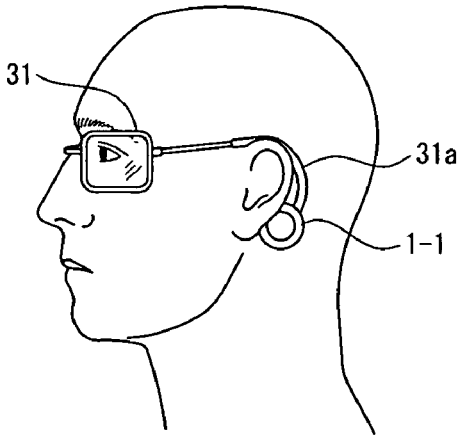
FIG. 20 is a diagram showing an example of integration of spectacles and a microphone.

For instance, as shown in FIG. 20, the microphone 1-1 may be disposed at an end of a temple 31*a* of spectacles 31 to be hooked on an ear.

Figure 21:
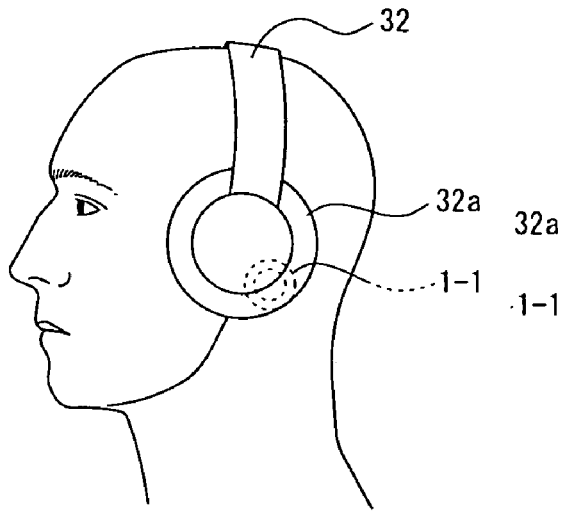
FIG. 21 is a diagram showing an example of integration of headphones and a microphone.
Figure 22:
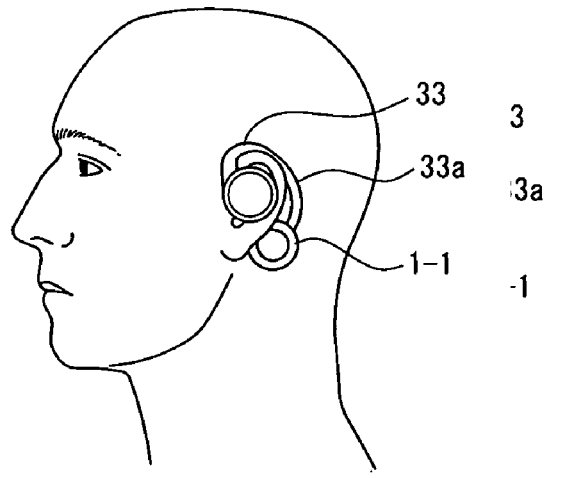
FIG. 22 is a diagram showing an example of integration of an earphone and a microphone.

Or, as shown in FIG. 21, the microphone 1-1 may as well be disposed within an ear-piece 32*a* of headphones 32. Similarly, as shown in FIG. 22, the microphone 1-1 may as well be disposed at an end of the temple 33*a* of an earphone 33.

Figure 23:
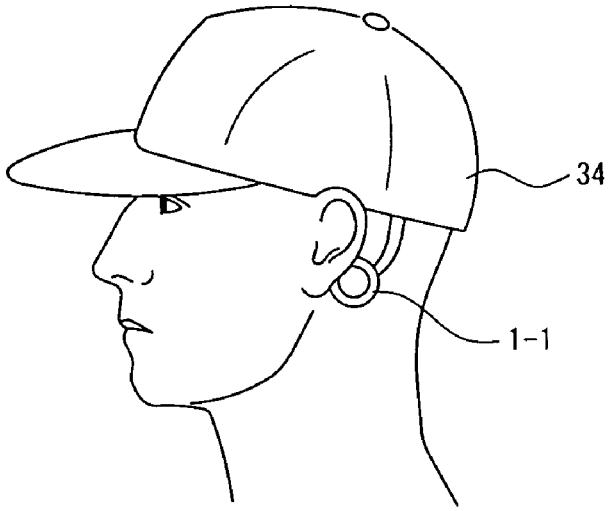
FIG. 23 is a diagram showing an example of integration of a cap and a microphone.
Figure 24:
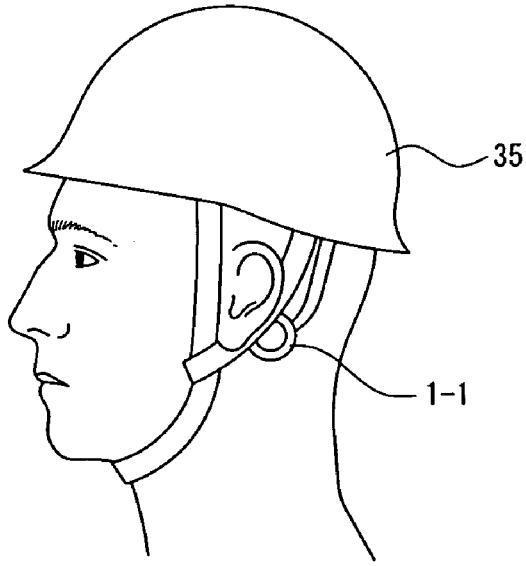
FIG. 24 is a diagram showing an example of integration of a helmet and a microphone.

Further as shown in FIG. 23, a cap 34 and the microphone 1-1 may be configured integrally. Similarly, as shown in FIG. 24, a helmet 35 and the microphone 1-1 may be configured integrally. By integrating any of these items with the microphone, the microphone can be used with no awkward feeling in a work site or a construction site, and communication of satisfactory quality is made possible even if surrounding noise is loud.

By integrating any of various head wearing objects with the microphone, the microphone can be worn with no awkward feeling. Moreover, by contriving the arrangement of the microphone, the microphone can be properly fitted in the sub-mastoid part.

Further, the microphone according to the present invention can as well be built into a mobile telephone or the like. In this case, if that microphone portion is pressed against the skin surface over the sternocleidomastoid muscle immediately below the mastoid, a conversation utilizing non-audible murmurs will be made possible.

Although the foregoing description referred to non-audible murmurs, it goes without saying that the invention of the present application can be applied to normal speech involving regular vibrations of the vocal cords and having greater energy than non-audible murmurs.

Although the foregoing description referred to hardened silicone rubber as a substance having an acoustic impedance close to that of soft tissues in the body, it goes without saying that realization is also possible with any other substance having similar biocompatibility and acoustic impedance.

Although the above-described configuration used a condenser microphone as the microphone element, it goes without saying that the invention of the present application can be applied to some others including a dynamic microphone, piezoelectric element and a silicone microphone of MEMS (micro-electromechanical system).

The present invention can be suitably utilized in a mobile telephone, any item having a speech recognizing function, and in the field of software service in devices intended for handicapped persons disable to utter normal speech involving vibration of the vocal cords on account of removal of the vocal cords or a similar circumstance.

The present invention makes available a voiceless conversation by mobile telephone or the use of a voiceless speech recognition device.

Thus, a conversation by mobile telephone or information inputting to a computer and a personal digital assistant terminal is made possible solely by motions of an articulatory organ, cultivated by naturally acquired verbal culture without having to acquire any new skill.

Moreover, no background noise around would come in, nor would a quiet environment be disturbed. Especially, publicity of verbal language is made controllable, making it unnecessary to worry about information leaks to the surroundings.

Furthermore, in usual speech recognition as well, the invasion of noise can be substantially reduced by the sound sampling method.

There is another advantage that the user is relieved from the trouble of fitting the microphone in front of his eyes or just at the mouth or the need to place the mobile telephone against an ear by one hand, and the microphone has only to be fitted inconspicuously downward behind the auricle, sometimes hidden under hair.

It is considered that there is the possibility of birth of a new verbal communication involving no utterance of normal speech, and the spread of the whole speech recognition technology in real life will be greatly promoted. Moreover, this can be suitably utilized for persons deprived of their vocal cords or handicapped in speech utterance using regular vibrations of their vocal cords.

The invention claimed is:

1. A microphone apparatus, comprising:

a condenser microphone portion having a pair of diaphragm electrodes; and a contact portion having an acoustic impedance matching an acoustic impedance of soft tissues in a body of a speaker, the contact portion being affixed to the condenser microphone portion with no intervening air space and conducting input speech vibrations from a skin surface of the speaker to the condenser microphone portion, wherein the apparatus is adapted for installation on a portion of the skin surface behind an auricle, over a sternocleidomastoid muscle, and below a mastoid of a skull, wherein the microphone samples, as the input speech vibrations, at least one of:

a non-audible murmur comprising vibration sounds that are articulated by a variation in resonance filter characteristics associated with motion of a phonatory organ that is not a regular vibration of vocal cords, the vibration sounds being generated when a respiratory sound that is not understandable by persons other than the speaker is transmitted through internal soft tissues;

a whisper comprising audible vibration sounds that are generated without regularly vibrating the vocal cords; or audible vibration sounds that are generated by regularly vibrating the vocal cords, and including one or more of a voice having a volume below that which is understandable by persons other than the speaker, an audible murmur, a teeth gnashing sound, and a tongue clucking sound.

2. The microphone according to claim 1, wherein said contact portion is formed of hardened silicone rubber.

3. The microphone according to claim 2, wherein said hardened silicone rubber not only covers said condenser microphone portion but also fills the whole inside of the microphone.

4. The microphone according to claim 2 or claim 3, wherein the hardness of said hardened silicone rubber is not higher than 30(Shore A).

5. The microphone according to claim 2 or claim 3, wherein said hardened silicone rubber is addition reaction-setting organo-polysiloxane, silica fine powder is 10 to 60 weight parts, and organo-hydrogen polysiloxane is 1 to 60 weight parts.

6. The microphone according to claim 1, wherein the shape of said contact portion is such that the sectional area thereof becomes gradually smaller from said condenser microphone portion toward said skin surface.

7. The microphone according to claim 1, wherein the shape of said contact portion is such that the sectional area thereof becomes gradually larger from said condenser microphone portion toward said skin surface.

8. The microphone according to claim 1, wherein said condenser microphone portion is disposed submerged in said contact portion.

9. The microphone according to claim 8, further comprising a reinforcing portion which is harder than said contact portion and covers other parts than the face of the contact portion coming into contact with said skin surface, and a reflector which is disposed on the interface between said contact portion and said reinforcing portion and reflects said non-audible murmurs.

10. The microphone according to claim 9, wherein said condenser microphone portion is turned upside down.

11. The microphone according to claim 10, wherein said reflector has a parabolic shape, namely a shape following a parabola.

12. The microphone according to claim 1, wherein it is configured integrally with a head wearing object to be fitted to the head of a human, such as spectacles, headphones, an earphone, a cap or a helmet.

13. A signal processing device which processes an input signal sampled by the microphone according to claim 1.

14. A communication interface system which uses for communication the input signal processed by the signal processing device according to claim 13.

15. A sound sampling method by use of a microphone that comprises a condenser microphone portion having a pair of diaphragm electrodes, and a contact portion having an acoustic impedance matching an acoustic impedance of soft tissues in a body of a speaker, the contact portion being affixed to the condenser microphone portion with no intervening air space and conducting input speech vibrations from a skin surface of the speaker to the condenser microphone portion, the sound sampling method comprising:

installing the microphone on a portion of the skin surface behind an auricle, over a sternocleidomastoid muscle, and below a mastoid of a skull;

sampling, as the input speech vibrations, at least one of:

a non-audible murmur comprising vibration sounds that are articulated by a variation in resonance filter characteristics associated with motion of a phonatory organ that is not a regular vibration of vocal cords, the vibration sounds being generated when a respiratory sound that is not understandable by persons other than the speaker is transmitted through internal soft tissues;

a whisper comprising audible vibrations sounds that are generated without regularly vibrating the vocal cords; or audible vibration sounds generated by regularly vibrating the vocal cords, and including one or more of a voice having a volume below that which is understandable by persons other than the speaker, an audible murmur, a teeth gnashing sound, or a tongue clucking sound.

* * * * *